US007140960B2

(12) United States Patent
Pilger

(10) Patent No.: US 7,140,960 B2
(45) Date of Patent: Nov. 28, 2006

(54) BOOT HANGER MOUNTING BRACKET

(75) Inventor: Allan Pilger, Longview, WA (US)

(73) Assignee: Applied Applications International, Inc., Longview, WA (US)

( * ) Notice: Subject to any disclaimer, the term of this patent is extended or adjusted under 35 U.S.C. 154(b) by 186 days.

(21) Appl. No.: 10/828,077

(22) Filed: Apr. 19, 2004

(65) Prior Publication Data

US 2005/0003754 A1 Jan. 6, 2005

Related U.S. Application Data

(63) Continuation-in-part of application No. 10/194,570, filed on Jul. 11, 2002, now Pat. No. 6,866,579.

(51) Int. Cl.
*F24F 7/04* (2006.01)

(52) U.S. Cl. ..... 454/331; 454/292

(58) Field of Classification Search ..... 454/330, 454/331, 292, 339, 346, 354; 52/220.1, 302.1
See application file for complete search history.

(56) References Cited

U.S. PATENT DOCUMENTS

| | | | | |
|---|---|---|---|---|
| 465,561 | A | 12/1891 | Hood | 454/330 |
| 943,298 | A | 12/1909 | Brown | |
| 1,690,948 | A | 11/1928 | Rote | |
| 2,679,796 | A | 6/1954 | Froelich et al. | 98/114 |
| 3,238,860 | A | 3/1966 | O'Day et al. | 98/40 |
| 3,323,437 | A | 6/1967 | Knab | 454/237 X |
| 3,522,724 | A | 8/1970 | Knab | 454/297 X |
| 3,636,340 | A | 1/1972 | Mulvey | 240/9 R |
| 3,645,044 | A | 2/1972 | Akre | 49/465 |
| 3,788,206 | A | 1/1974 | Mulvey | 98/40 |
| 3,888,013 | A | 6/1975 | Benoit | 33/174 |
| 3,955,483 | A | 5/1976 | Sunter | 98/114 |
| 3,985,158 | A | 10/1976 | Felter | 454/292 X |
| 4,122,762 | A * | 10/1978 | Williams | 454/292 |
| 4,258,784 | A | 3/1981 | Perry et al. | 165/166 |
| 4,372,763 | A | 2/1983 | Champlin et al. | 55/501 |
| D268,282 | S | 3/1983 | Wichmann et al. | D23/393 |

(Continued)

OTHER PUBLICATIONS

Product description regarding incandescent lamps [online] [retrieved on Apr. 19, 2004] Retrieved from the Internet : <URL: http://www.junolighting.com.

(Continued)

*Primary Examiner*—Gregory Wilson
(74) *Attorney, Agent, or Firm*—Cislo & Thomas, LLP

(57) ABSTRACT

The present invention relates to duct systems, registers and ductwork components used with floor or ceiling registers employed in warm air heating, ventilating and air conditioning systems, and specifically to improvements for mounting and installing the components of the duct system, including register boots, mud rings and register grilles, in the walls, floors or ceilings of buildings components, mud ring, register grille and wall, floor or ceiling opening, which reduces costs.

The invention includes an adjustable boot hanger mounting bracket assembly comprising a boot hanger frame portion and a support member portion; the ductwork components, which may include a pre-fabricated can-boot/mud ring assembly; a pair of boot hanger arms; and a register grille. The boot hanger mounting bracket assembly is formed of a sturdy yet bendable material so that it can be configured and adjusted on-site. Once configured, the boot hanger mounting bracket assembly is secured to the building structure by a securing a pair of boot hanger arms to the ceiling joists, wall studs or other support structure. In this way, the boot hanger mounting bracket, through a direct attachment to the ceiling joist or wall stud, provides a positive inexpensive simple and error free way to mount the duct components.

36 Claims, 24 Drawing Sheets

U.S. PATENT DOCUMENTS

| | | | | |
|---|---|---|---|---|
| 4,377,107 | A | 3/1983 | Izumi | 98/40 |
| 4,558,582 | A | 12/1985 | Meinig | 72/381 |
| 4,760,981 | A | 8/1988 | Hodges | 248/57 |
| 4,815,364 | A | 3/1989 | Wagner et al. | 98/114 |
| 5,129,690 | A | 7/1992 | Meinig et al. | 285/363 |
| 5,338,255 | A | 8/1994 | Akehurst | 454/292 |
| 5,338,256 | A | 8/1994 | Tonna | 454/310 |
| 5,476,183 | A | 12/1995 | Harpenau | 220/3.3 |
| 5,505,419 | A | 4/1996 | Gabrius | 248/343 |
| 5,716,270 | A | 2/1998 | Chambers | 454/332 |
| 5,741,030 | A | 4/1998 | Moore et al. | 285/23 |
| 5,792,230 | A | 8/1998 | Moore et al. | 55/493 |
| 5,928,078 | A | 7/1999 | Moore et al. | 454/330 |
| 5,983,496 | A | 11/1999 | Hermanson | 29/890.15 |
| 6,007,422 | A * | 12/1999 | Van Becelaere | 454/273 |
| 6,192,640 | B1 | 2/2001 | Snyder | 52/302.1 |
| RE37,086 | E | 3/2001 | Moore et al. | 454/330 |
| 6,234,894 | B1 | 5/2001 | Goracke et al. | 454/290 |
| 6,261,174 | B1 | 7/2001 | Kuehn | 454/290 |
| 6,290,597 | B1 | 9/2001 | Jones et al. | 454/303 |
| 6,302,784 | B1 | 10/2001 | Berger | 454/289 |
| D453,042 | S | 1/2002 | Mattsson et al. | D23/393 |
| D454,949 | S | 3/2002 | Mattsson et al. | D23/393 |
| D456,071 | S | 4/2002 | Mattsson et al. | D23/393 |
| D456,072 | S | 4/2002 | Mattsson et al. | D23/393 |
| 6,494,780 | B1 | 12/2002 | Norbury, Jr. | 454/319 |
| D475,131 | S | 5/2003 | Pilger | D23/393 |
| 6,652,375 | B1 * | 11/2003 | Donnelly | 454/330 |

OTHER PUBLICATIONS

Photograph of device from Royal (North Carolina).

* cited by examiner

BOOT HANGER MOUNTING BRACKET

CROSS-REFERENCES TO RELATED APPLICATIONS

This patent application claims priority from and is a continuation in part of U.S. patent application Ser. No. 10/194,570 filed Jul. 11, 2002, now U.S. Pat. No. 6,866,579 for BOOT HANGER MOUNTING BRACKET, which application is incorporated herein by this reference thereto.

BACKGROUND OF THE INVENTION

1. Field of the Invention

This invention relates to duct systems, registers and register boots, used as air ducts for warm air heating, ventilating and air conditioning systems, and specifically to improvements for mounting and installing the components of the duct system, including register boots, mud rings and air registers, in the walls, floors or ceilings of buildings.

2. Description of the Related Art

Forced air heating, cooling and ventilation systems, or "HVAC systems" are designed to provide control of space temperature, humidity, air contamination, differential pressurization, and air motion. These distribution systems use a network of ducts to deliver the heated and/or cooled air to the various rooms and spaces within a building structure. Of the many HVAC systems currently available, galvanized sheet steel duct systems are among the most widely used. These systems generally consist of an air heating and/or refrigeration unit, straight sections of duct, and multiple types of fabricated fittings and connections. From these fittings and connections, the straight sections of duct are connected to each other and to openings or vents in the rooms and spaces of the building structure. Currently, the ductwork connections and fittings are fabricated primarily by experienced sheet metal workers.

Where the ducts are accurately sized and the duct system is correctly designed, the air will be delivered to the rooms and spaces with a minimum of resistance. In HVAC systems, the ductwork interfaces with the room through one or more open-end duct portions. Generally, a grille or louver is mounted on the interfacing end of the duct to face into the room. Because the grilles generally must be mounted to the wall studs or ceiling joists, or to the ducts themselves, there is a risk that the grilles may be insecurely mounted or mounted at odd angles, particularly where the grilles are first attached and subsequently temporarily removed for wall painting or cleaning or other purposes.

Several considerations regarding the design of the connections and fittings used in HVAC systems are important. First, the connections and fittings are difficult to store, handle, and transport without incurring damage. In addition, due to their shape and design, they require a large quantity of space per unit to store and transport. These problems cause the production of excessive scrap and increased inventory holding and transportation costs for the distributor and customers.

Additionally, the configuration of the ductwork and grilles poses a problem for unskilled construction workers and is extremely time consuming. Generally, this work involves fitting together preformed components that frequently differ in dimensions and require careful measuring and positioning during the installation process so that the components fit together and so that no gaps are created. For example, a worker will commonly transpose the dimensions of the grille register onto the area of the wall or ceiling opening to ascertain the dimensions of the opening to be cut; or alternately he will select a standard size commercially available register grille to fit into a pre-existing opening. Because any measurements can introduce inaccuracies, the possibility that the components will not fit together or provide support for the grille register and boot in the wall or ceiling opening or create gaps between the edges of the opening and the grille register is a real concern. In these cases, another bracket must be brought to the site and used, or the grille opening must be modified or the grille register replaced with a different size so that the components fit together and so that the register and boot are securely supported in the opening in the wall or ceiling.

In light of the problems noted above and in an attempt to speed up the installation process and avoid waste of materials, new installation methods and devices have been sought. The present invention allows for easy transportation, storage and on-site installation while providing an adjustable assembly that provides solid backing for mounting the ductwork components.

SUMMARY OF THE INVENTION

It is an object of the present invention to overcome the above and other drawbacks by providing an assembly to support and mount ductwork components of heating, cooling and ventilation systems. The assembly has a simple and versatile construction and can be quickly and easily assembled. Further, the assembly may be stored and transported in a flattened state, and can be adjusted on-site to provide an accurate fit between the boot register, grille and wall, floor or ceiling opening, which reduces costs.

Generally, the invention includes a boot hanger mounting bracket assembly comprising a boot hanger frame portion and at least one support member; ductwork components such as a can-boot and mud ring that may be prefabricated; a pair of boot hanger arms; and an airflow control means, such as a register grille. The boot hanger mounting bracket assembly is preferably configured so that the boot hanger frame portion interfaces with the support member(s) and comprises two pairs of parallel rearward projecting flanges along its sides.

The support member preferably comprises a tabbed portion or "lip" and a pair of parallel sidewalls. The lip of the support member is preferably configured at an approximate right angle to the sidewalls of the support member so that the lip may lie flush against the surface of the boot hanger frame portion. The lip may be secured to the boot hanger frame portion by a securing material such as, for example, spot welds, button punches, epoxy or riveting, or other suitable means known in the art.

The boot hanger frame portion and support member(s) are preferably configured so that a portion of the support member(s) projects beyond the front face of the boot hanger frame portion to receive the airflow control means. The support member, and the boot hanger frame portion, may be pre-formed or may be transported in a low profile state to the work site so that the boot hanger mounting bracket assembly can be configured on-site to interface with the particular ductwork components, such as can-boot, and register grilles.

The support member may be formed of a sturdy yet bendable material so that it can be configured, on-site if desired, to form a pocket, into which a portion of, or an edge of, the boot or other duct work component sits and to form the lip, which interfaces with and is preferably secured to the boot hanger fame portion. The finished boot hanger mounting bracket assembly may then be secured to the building structure by securing the boot hanger arms to the boot hanger frame portion and to the ceiling joists, wall studs or other structure. In this way, the boot hanger mounting bracket assembly, through a direct attachment to the ceiling joist or wall stud, provides a positive inexpensive simple and error free way to mount the duct components.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
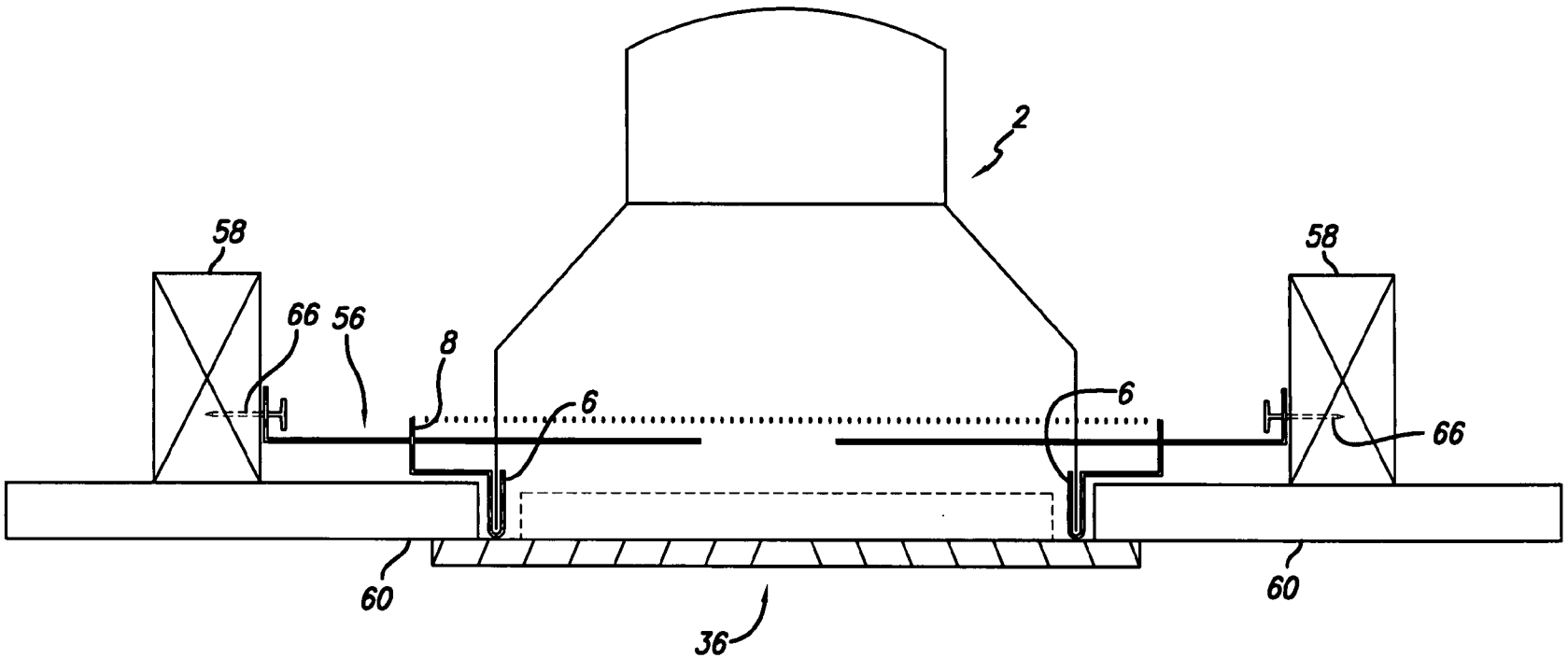
FIG. 1 is a cutaway side view of the present invention mounted in a structure between two ceiling joists.

Turning to the drawings, and more particularly to FIG. 1, the typical environment which the present invention is operated is illustrated. As shown in FIG. 1, a typical vertical ceiling joist 58 is shown. Although FIG. 1 illustrates the present invention mounted in a ceiling, it is contemplated that the present invention may be mounted within the floor, wall, ceiling, or other portion of a building structure. Attached to the ceiling joist 58 is a ceiling lid 60 formed from materials such as dry wall or sheet rock. FIG. 1 also shows an airflow control means 36, such as an air register grill or louver, mounted within the ceiling of a room.

The present invention generally may comprise pre-fabricated ductwork components such as a can-boot 2; a boot hanger mounting bracket assembly 4 comprising at least one support member 6 and a boot hanger frame portion 8; and a pair of boot hanger arms 56. The present invention contemplates that the can-boot or other ductwork component 2 may be pre-fabricated and fit together prior to arriving at the work site, or alternately, semi-fabricated and configured at the site. The invention may be used with an airflow control means 36 and may include a commercially available standard register grille or grilles. The boot hanger arms 56 may be mounted to the ceiling joists 58 by fastening member such as, for example, nails or screws. It is contemplated that the invention may be disposed within an opening that is in communication with the ductwork of a central heating or cooling system or a ventilation system (not shown) of a structure.

Figure 2:
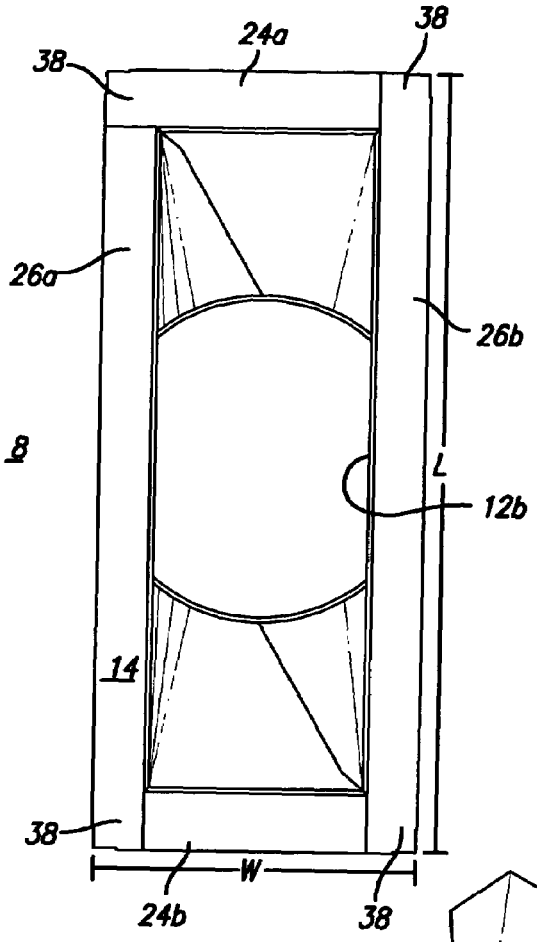
FIG. 2 is a front plan view of the boot hanger frame portion and interior of the can-boot and mud ring components of the ductwork.
Figure 3:
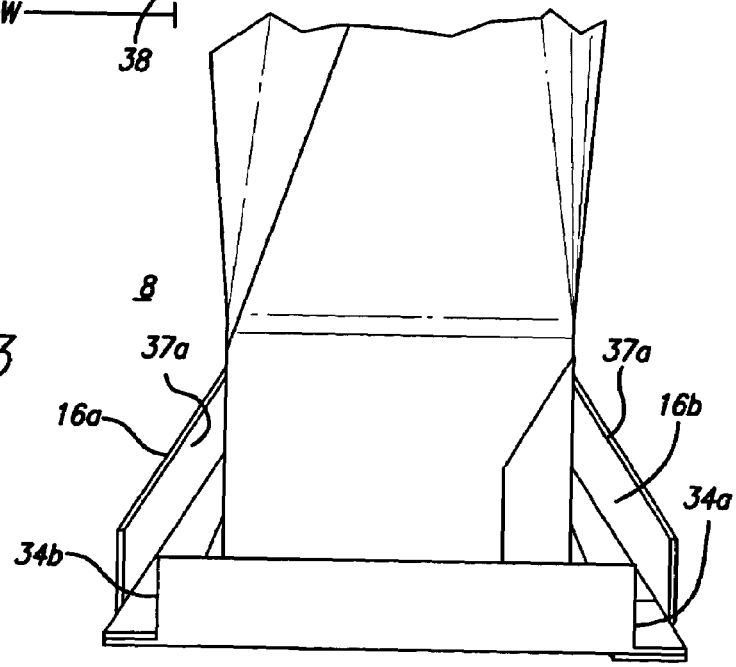
FIG. 3 is a close-up side view of the boot hanger frame flanges and can-boot component of the ductwork in a third version of the present invention.
Figure 4:
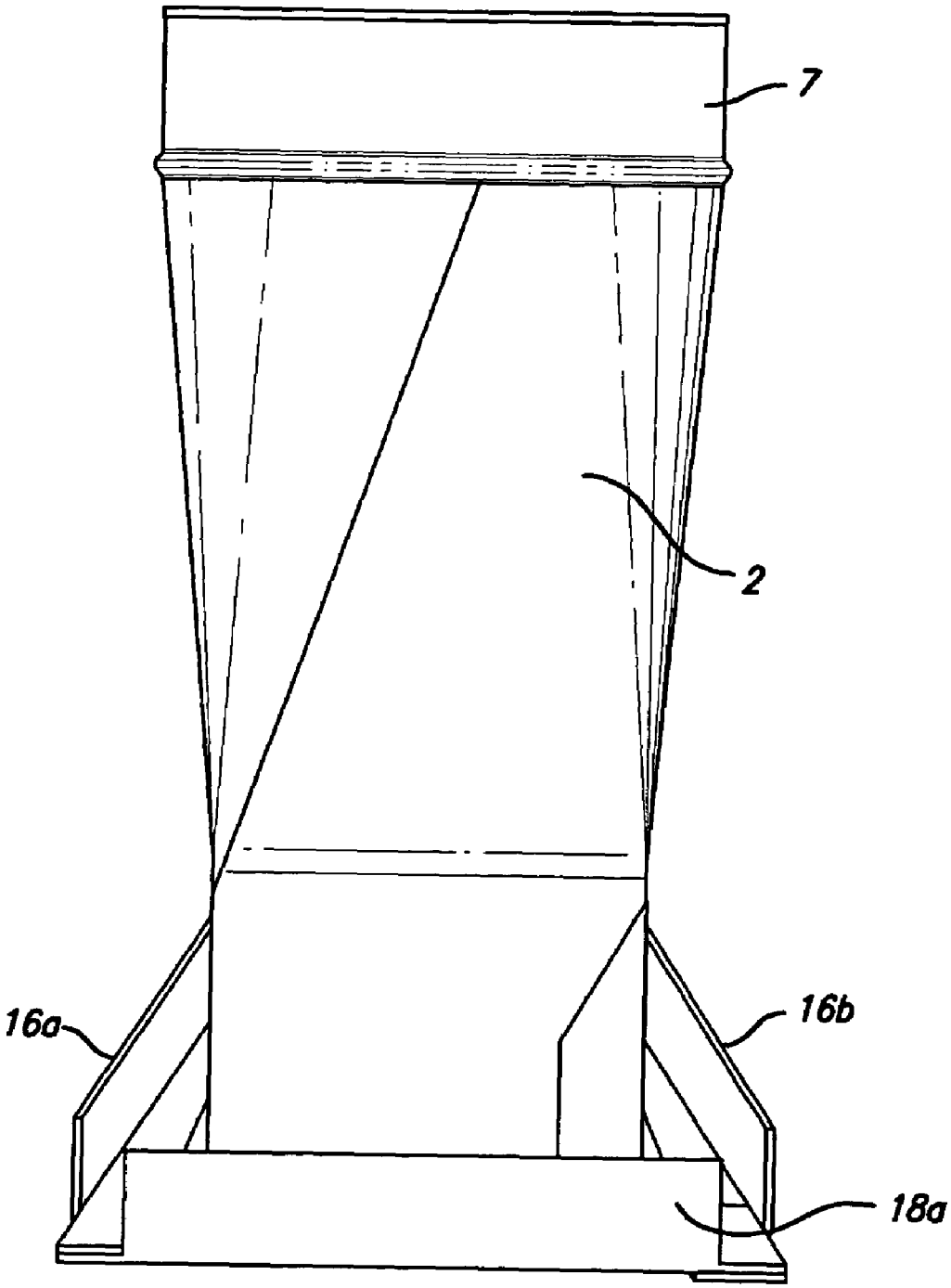
FIG. 4 is a side view of the boot hanger frame flanges and can-boot component of the ductwork in a third version of the present invention.
Figure 5:
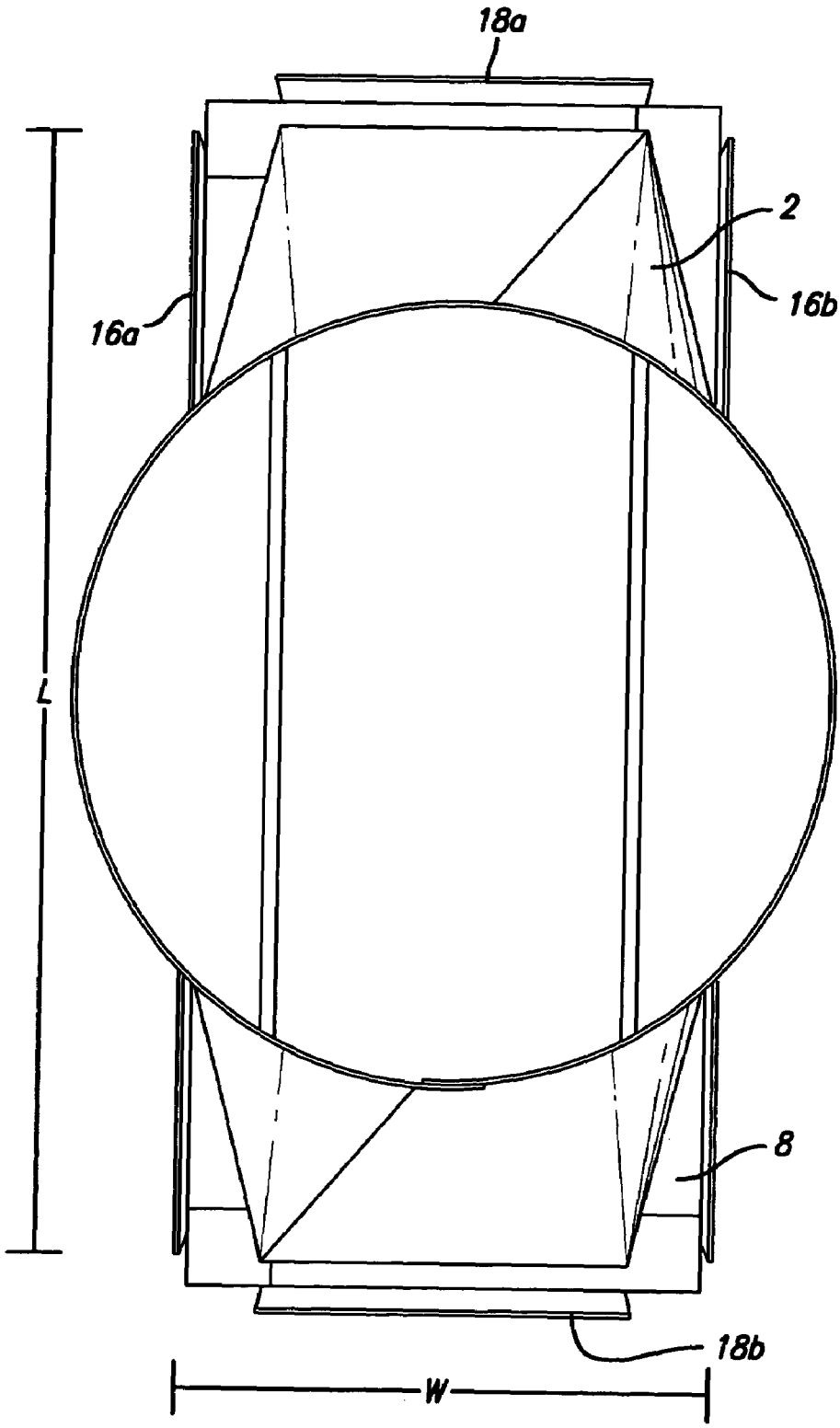
FIG. 5 is a top plan view of a mud ring, can-boot and boot hanger frame portion in a third version of the present invention.
Figure 6:
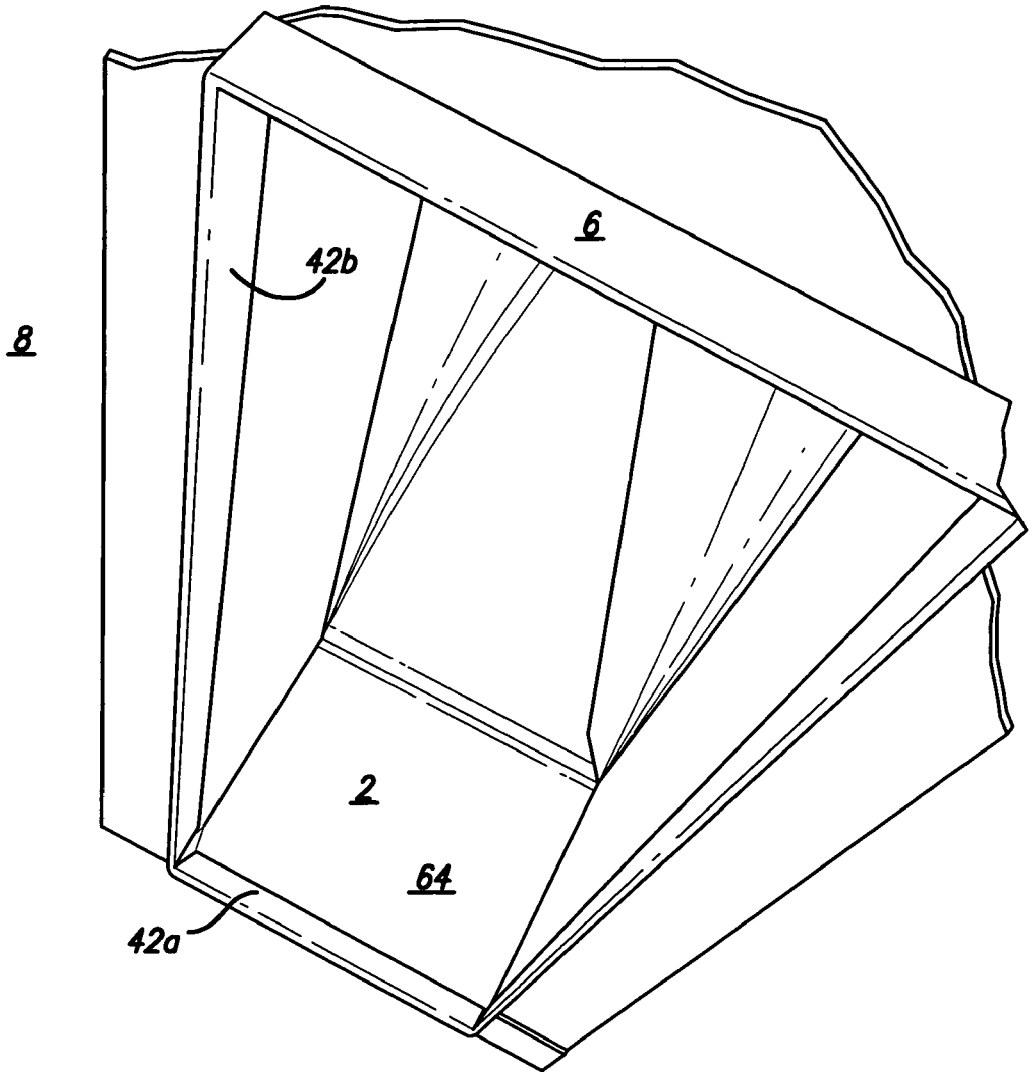
FIG. 6 is a perspective bottom view of the present invention showing the interior of the can-boot, the interface of the can-boot edges and the support member and the boot hanger frame.

The support member 6 and boot hanger frame portion 8 has a length, l dimension and width dimension, w, and when fitted together to form the boot hanger mounting bracket 4, defines an opening 12*b* (FIG. 2). The size of the opening 12*b* may vary to fit most residential and commercial HVAC needs and grille or register sizes. By way of example only, in a first version of the preferred embodiment, the boot hanger frame portion 8 and support member 6 may be configured to form a boot hanger mounting bracket assembly 4 having an opening 12*b* of approximately thirty (30) cm in length by approximately ten (10) cm in width. Examples I. and II. herein illustrate without limitation other suitable dimensions of the components of the boot hanger mounting bracket assembly 4. The dimensions the boot hanger mounting bracket assembly 4, and its components, may vary according to the dimensions of the can-boot or other ductwork components 2, and airflow control means 36 required for the particular application.

Referring to FIGS. 2–5, the boot hanger frame portion 8 preferably comprises a planar surface 14 defining an opening 12*b* and two pairs of parallel rearward projecting flanges 16*a*, 16*b*, 18*a*, 18*b* along, respectively its length, l, and width, w. Each flange comprises a pair of parallel edges 34*a*, 34*b* and a rear edge 37*a*. In the preferred embodiment, the boot hanger frame portion 8 may be formed from a sheet of material by, for example, using stamping and cutting.

Alternately, the boot hanger frame portion 8 may be formed by separate components, such as, for example, two sets of parallel, galvanized metal strips 26*a*, 26*b* and 24*a*, 24*b* forming respectively, the length, l, and width, w, of the boot hanger frame portion 8 (see e.g. FIG. 2). The strips or flat sheet may be formed from materials comprising, for example, galvanized metals, aluminum, steel, high impact polystyrene or of resin formulations such as ABS resin, or other suitable materials known in the art.

Figure 14:
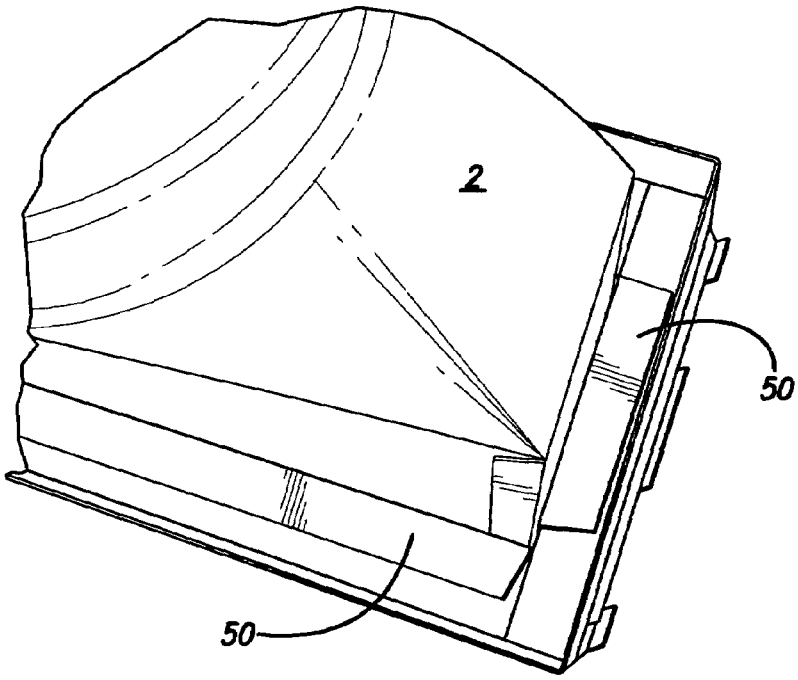
FIG. 14 is a top perspective view of the ductwork component and lip of the support member and the boot hanger frame portion in a first version of the preferred embodiment.

The boot hanger frame portion may be brought to the work site with the flanges 16*a*, 16*b*, 18*a*, 18*b* pre-formed, or the flanges may be formed on-site by, for example, manual bending of pre-etched lines or by use of a suitable metal working devices. In a first version of the preferred embodiment, two parallel flanges (e.g. 16*a*, 16*b* or 18*a*, 18*b*) are approximately the same length as the respective side of the boot hanger frame portion 8 from which they project. The remaining two parallel flanges are preferably slightly longer in length than the side of the boot hanger frame portion 8 from which they project to create an overlapping portion 102, which interfaces with, and may be secured to, the adjacent flange (e.g. FIG. 14, FIG. 21).

Figure 26A:
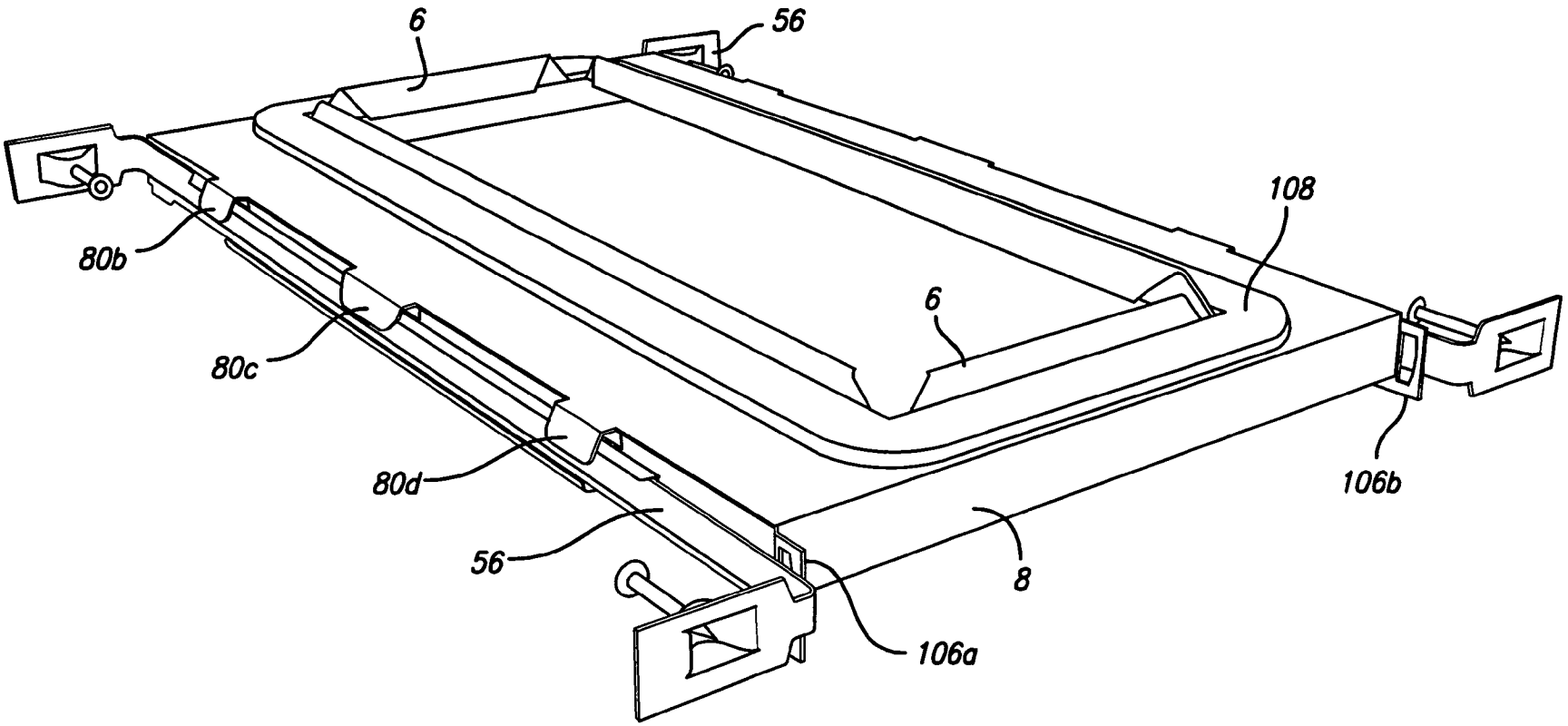
FIG. 26*a* is a side perspective view of the boot hanger mounting bracket and gasket.
Figure 26B:
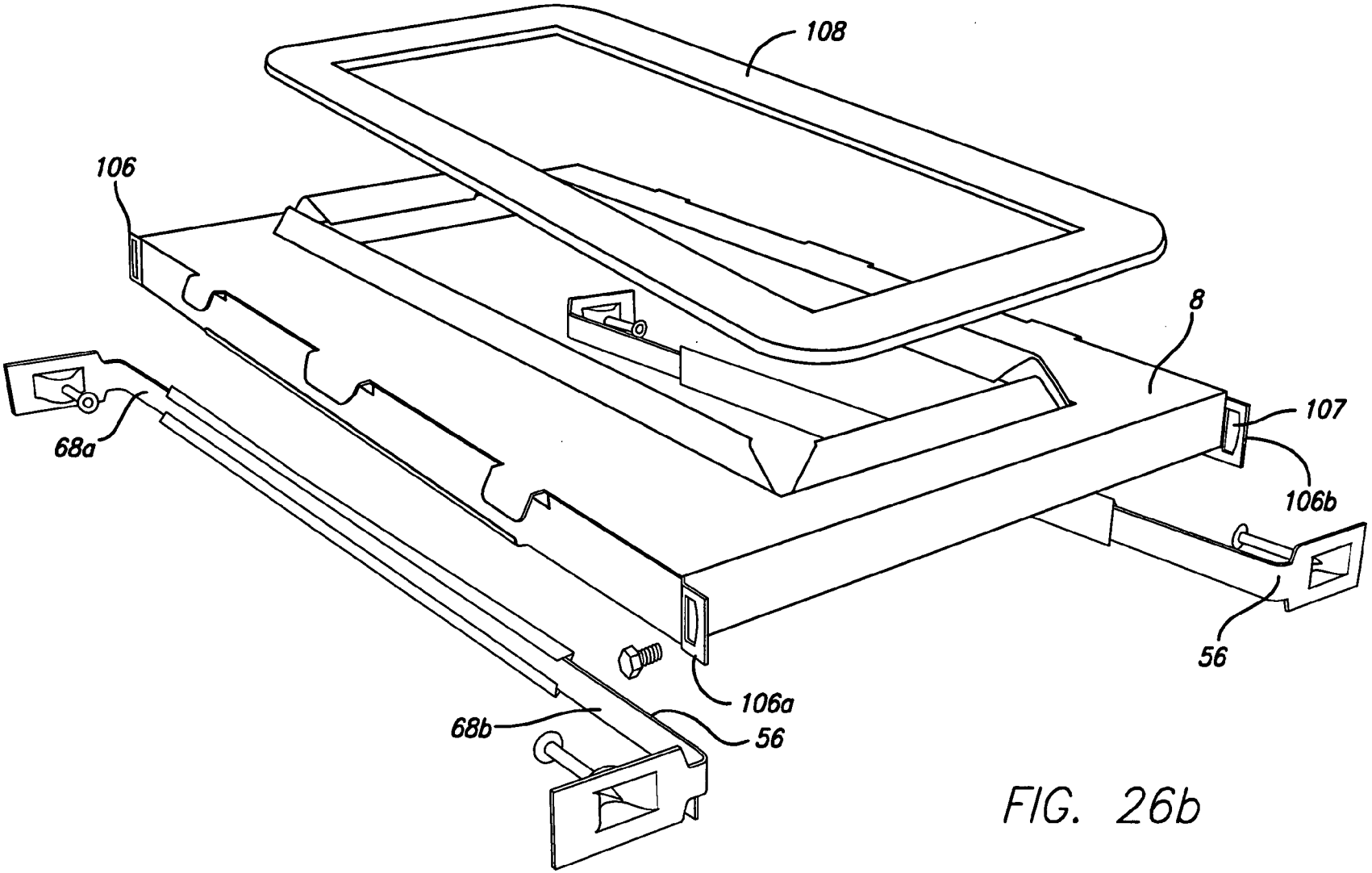
FIG. 26*b* is an exploded view of the boot hanger mounting bracket and gasket.
Figure 28:
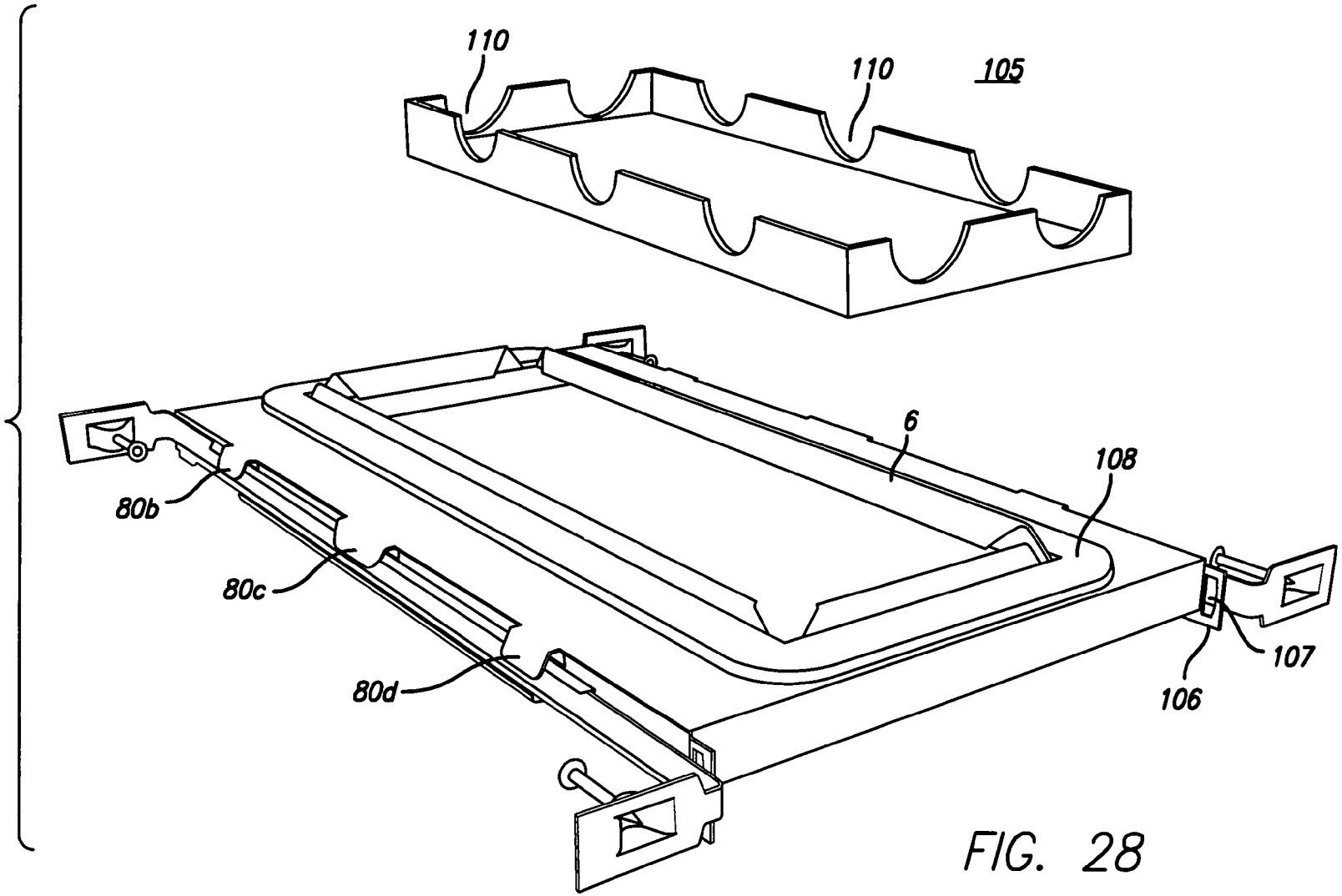
FIG. 28 is a semi-exploded side view of the boot hanger mounting bracket and insert.

In a second version of the preferred embodiment, at least two flanges are longer than the side of the boot hanger frame portion 8 from which they project. In this version, the longer flanges are preferably parallel to one another and extend beyond the end of the boot hanger frame portion 8 from which they project to form two extended portions 106*a*, 106*b*, as shown in FIGS. 26*a*, 26*b* and 28. Extended portion 106 preferably comprises a cut-out 107 that is configured to receive the boot hanger arms 56. In an alternate version of the invention, flanges 16*a*, 16*b*, 18*a*, 18*b* may be shorter in length than the respective sides of the boot hanger frame portion from which they project rearward, as shown in, for example, FIGS. 3–5.

The support member(s) 6 are configured to receive a portion of the can-boot, or other ductwork component, 2 and to interface with the boot hanger frame portion 8. The support members 6 may be pre-formed or taken to the site in a flattened or low profile state for easy transport. If formed on-site, the sides and dimensions of the support members 6 may be formed by manually bending the sheet material from which the support member portion 6 is formed, or by using suitable metal working devices known in the art. The material may comprise etched or marked lines 90 to facilitate the bending and formation process.

Figure 15:
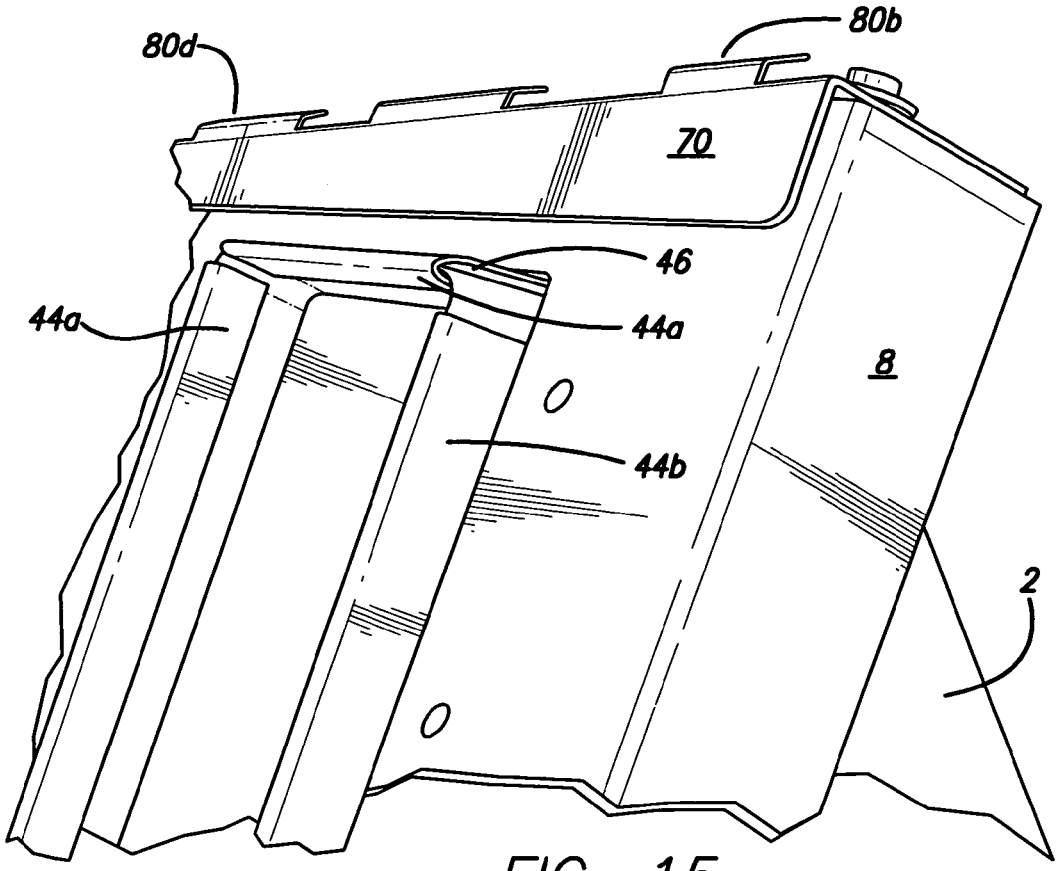
FIG. 15 is a side perspective view of the support member sidewalls, bracket, and the boot hanger frame portion in a first version of the preferred embodiment.
Figure 16:
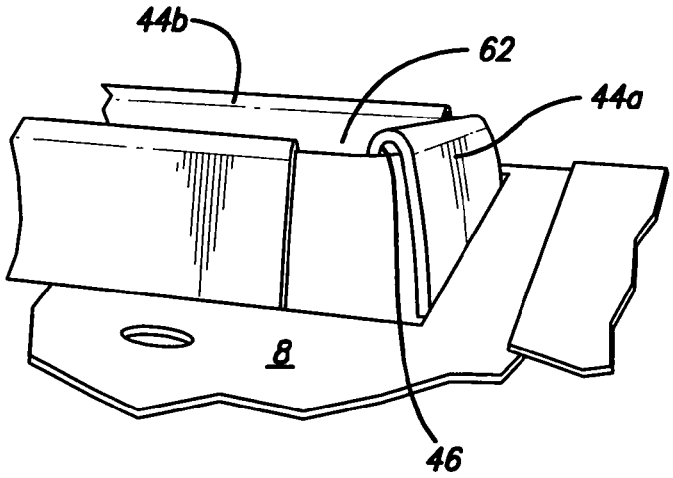
FIG. 16 is a close-up side perspective view of the support member sidewalls, pocket and the boot hanger frame portion in a first version of the preferred embodiment.
Figure 17:
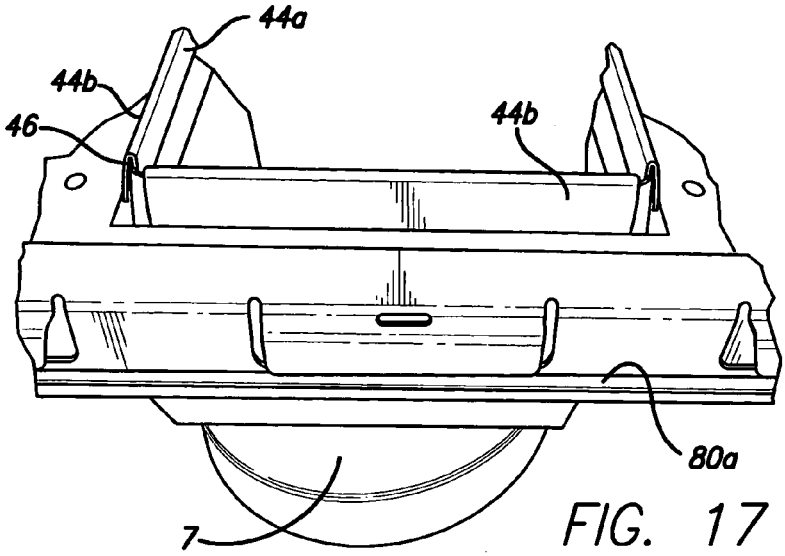
FIG. 17 is a front perspective view of the ductwork component and sidewalls of the support member and the bracket in a first version of the preferred embodiment.
Figure 27:
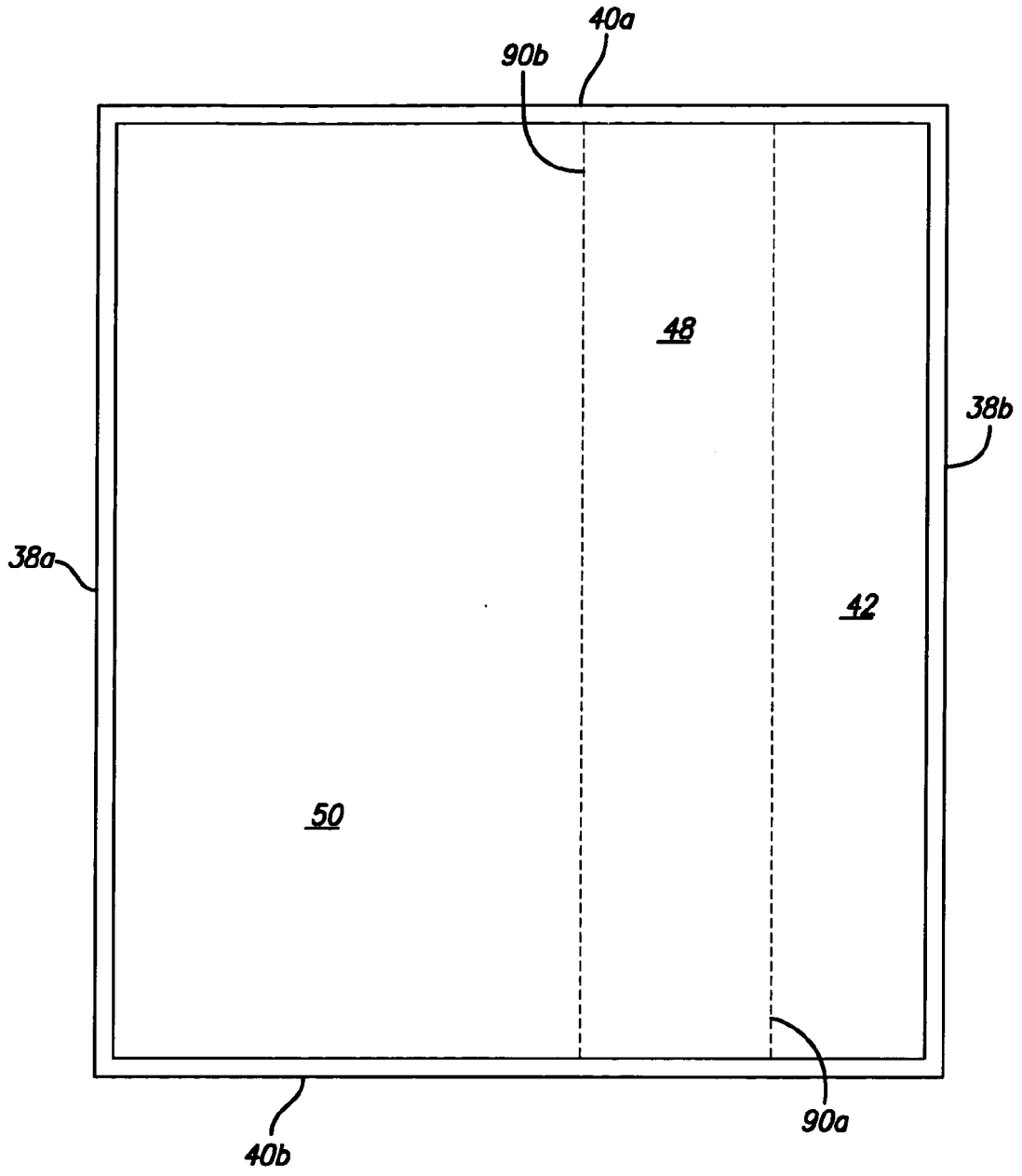
FIG. 27 is a diagram of the support member comprising pre-etched lines and the inner tab, outer tab and lip.

In the preferred embodiment, the support member 6 comprises a strip, piece or sheet of material having two sets of parallel sides 38*a*, 38*b* and 40*a*, 40*b* (FIG. 27). The support member 6 may be formed of galvanized metal, ABS plastic resin, aluminum, steel, or other suitable materials known in the art. In finished form, the support member 6 comprises a pair of parallel sides defining a slot or "pocket", and a lip (see e.g. FIGS. 15–16). The finished support member 6 may be formed from a flat sheet of material by folding or bending a portion of one side to form a first sidewall 44*a*, and by folding the opposite parallel side, preferably in an opposite direction, to form lip 50 and a second sidewall 44*b*. In the preferred embodiment, sidewalls 44*a*, 44*b* define a pocket 46 (see e.g. FIGS. 15–16).

Once the support member 6 is formed or semi-formed, it may be fit together with the boot hanger frame portion 8. The lip 50 may be formed at this time, or alternately may be formed before fitting the boot hanger frame portion 8 with the support member 6 and further adjusted in relation to the boot hanger frame portion 8. The lip 50 is preferably configured so that it lies flush against the surface 14 of the boot hanger frame portion 8.

In one version of the preferred embodiment, the sheet of material forming the support member 6 comprises an inner tab 42 and an outer tab 48. The inner tab 42 may be bent or folded in one direction; for example at pre-etched line 90*a*; and the outer tab 48 folded or bent in an opposite direction; for example at pre-etched line 90*b*; to configure a support member 6 comprising two sidewalls 44*a*, 44*b* defining a pocket 46, and lip 50. By way of example only, a support member 6 of approximately 4.5 cm wide to about 13.5 cm wide may comprise an inner tab 42 of approximately 1.0 cm to 3.0 cm in width and outer tab 48 of approximately 1.0 to 3.0 cm wide. In this example, inner tab 42 may be folded at line 90*a* in one direction and outer tab 48 may be folded at line 90*b* in an opposite direction to create approximately 1.0 to 3.0 cm sidewalls and a lip 50 of approximately 2.5 cm to about 7.5 cm.

The support member 6 may then be securely fastened to the boot hanger frame portion 8 by fastening lip portion 50 to its surface 14. The front edges 62 of the can-boot or other ductwork component 2 may then be fit into the pocket 46 created by the folded inner 42 tab.

Figure 29:
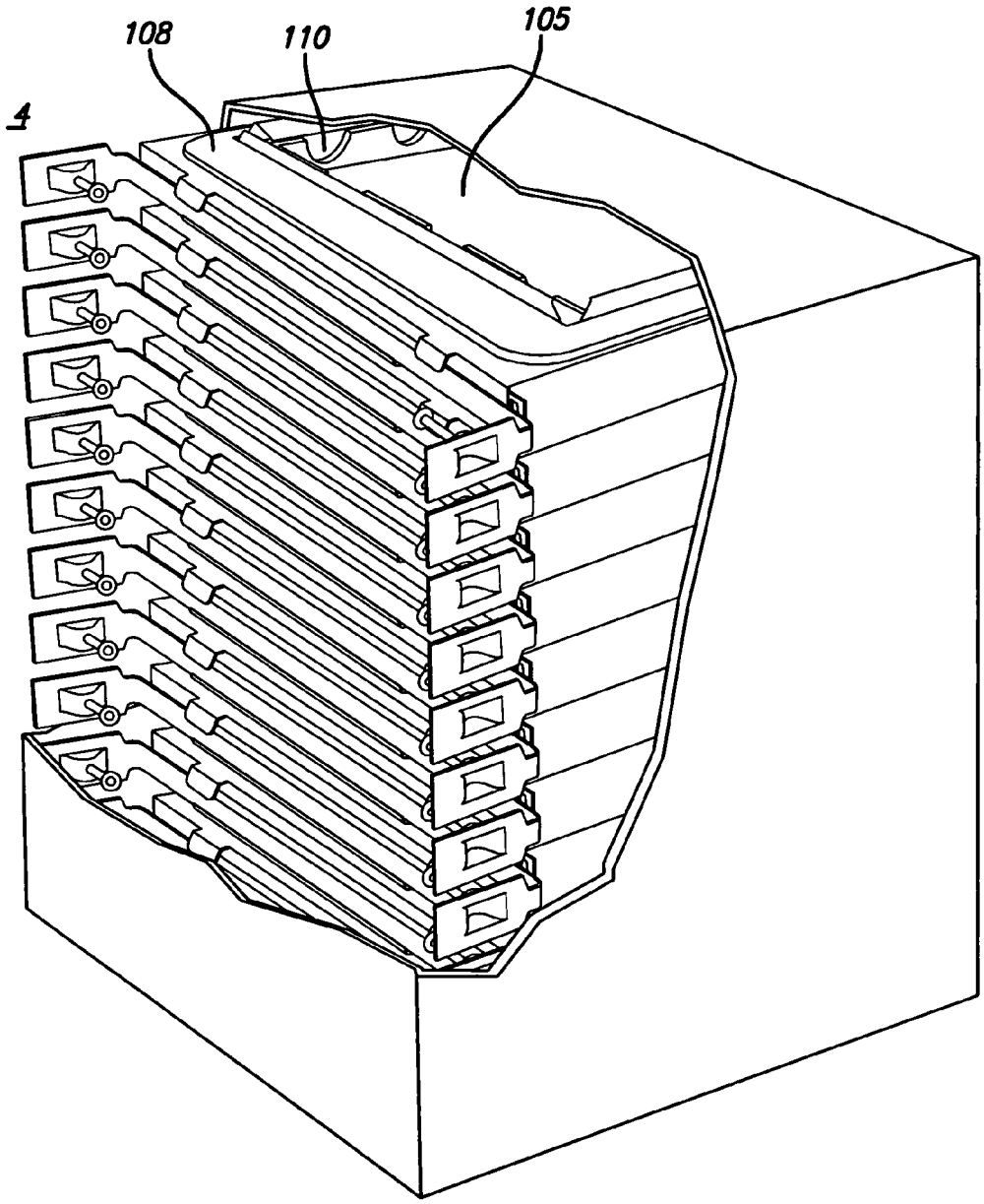
FIG. 29 is a side cut-away perspective view of multiple boot hanger mounting bracket assemblies stacked in a shipping carton and including the insert.

The invention disclosed herein permits flexibility in assembly in that the components may be brought in a compact form to the work site and assembled on site or may be brought to the work site pre-formed. In addition, the assembled boot hanger mounting bracket assemblies may be configured so that they stack together in a compact configuration for shipping (see e.g. FIG. 29) and are easily removable from the shipping carton.

Once the support member(s) 6 are fit together with the ductwork components 2, the material forming the sidewalls 44*a*, 44*b* of the support member 6 may then be pressed, stapled or otherwise adjusted by suitable means known in the art to provide a snug fit between the support member 6 and can-boot or other ductwork component 2. Alternately, the support member(s) may be configured so that it will expand, for example upon applying pressure, to receive a portion of the ductwork 2 component. In this version, the ductwork component may be removed and re-inserted into engagement with the support member 6. The adjustment step may be performed before or after securing the lip 50 to the boot hanger frame portion 8. Once adjusted, a portion of the folded inner tab 42 may be secured to the interior surface 64 of the can-boot or other ductwork component 2.

In the preferred and alternate embodiments, a gasket 108 may be used, for example, to prevent air from flowing past certain portions of the ductwork and/or to aid in sealing certain interfaces, including, for example, the interface between the assembled boot hanger mounting bracket 4 and the building structure (e.g. wall, ceiling or floor) and/or the interface between the support member(s) 6 and the boot hanger frame portion 8. By way of example, the gasket 108 may be disposed between the boot hanger mounting bracket 4 and the building structure (e.g. wall, floor or ceiling), or between the ductwork component 2 and the boot hanger mounting bracket 4. The gasket 108 is preferably comprised of a foam material but may comprise other suitable materials known in the art. The gasket may be secured by gluing or other suitable means known in the art.

Also, in the preferred and alternate embodiments, an insert 105 may be used in the opening 12*b* while assembling and installing the boot hanger mounting bracket 4 and ductwork components to prevent debris and materials outside the building structure from entering the interior of the building space and/or vice-versa. The insert 105 is preferably configured so that it can be easily removed at any time during or after completing installation of the ductwork or other components, or before operation of the heating, air conditioning or ventilation system. The insert 105 may comprise cardboard, corrugated cardboard, foam, plastic, sheet metal or other suitable materials known in the art. The insert 105 preferably comprises "half-moon" shaped indentations, holes 110 or other suitably-shaped indentations so that the insert 105 does not interfere with placement and configuration of the ductwork components 2 and so that it can be easily removed.

Figure 7:
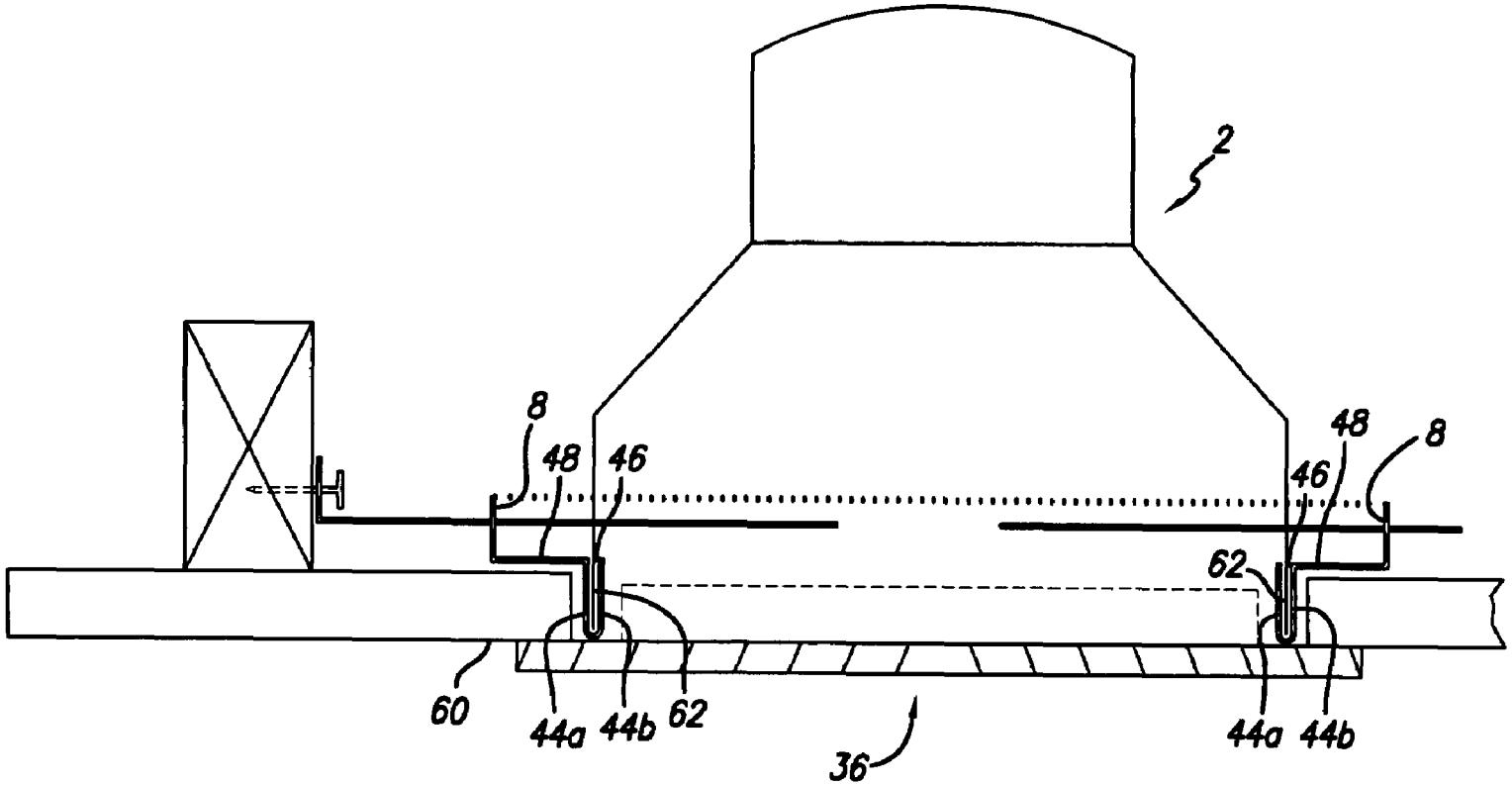
FIG. 7 is an enlarged cutaway side view of the present invention, as mounted between the ceiling joists of a structure, showing the pockets defined by the sidewalls of the support member.
Figure 8:
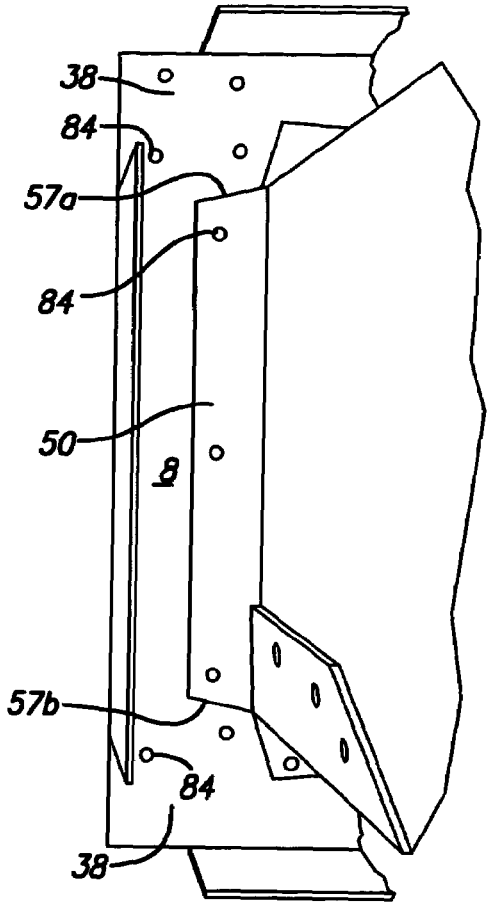
FIG. 8 is an enlarged top plan view of the boot hanger frame portion and can-boot, showing attachment of the lip of the support member to the front surface of the boot hanger fame in a third version of the present invention.
Figure 11:
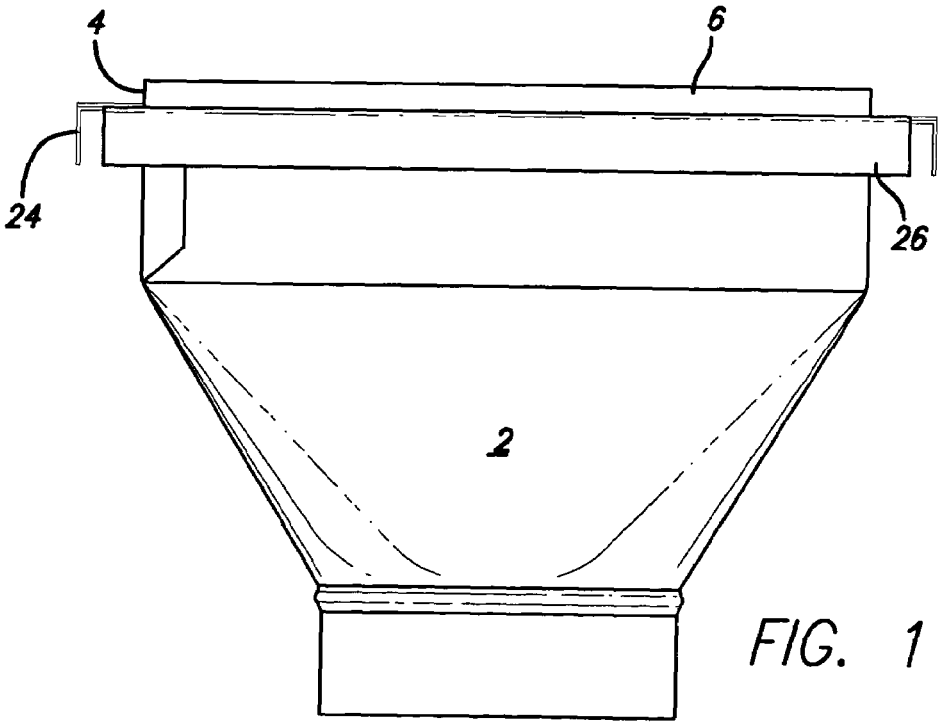
FIG. 11 is a side view of the mud ring, can-boot, boot hanger frame portion and support member in an alternate version of the present invention.
Figure 18:
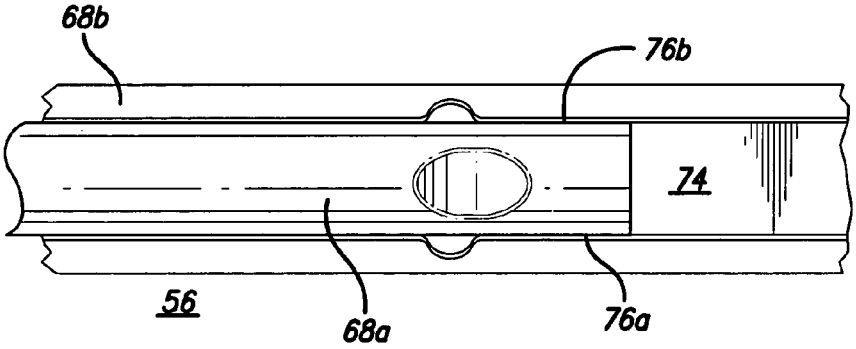
FIG. 18 is a rear perspective view of the elongated elements of the boot hanger arms in a first version of the preferred embodiment.
Figure 22:
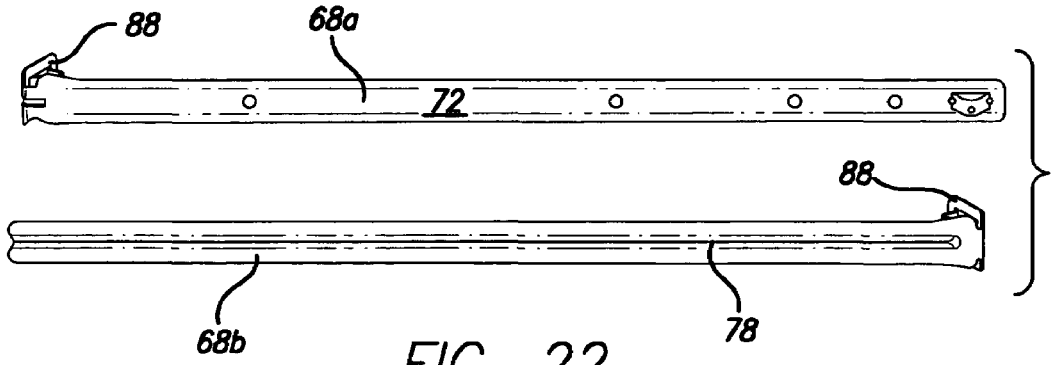
FIG. 22 is a front perspective view of the elongated elements of the boot hanger arms in a first version of the preferred embodiment.
Figure 23A:
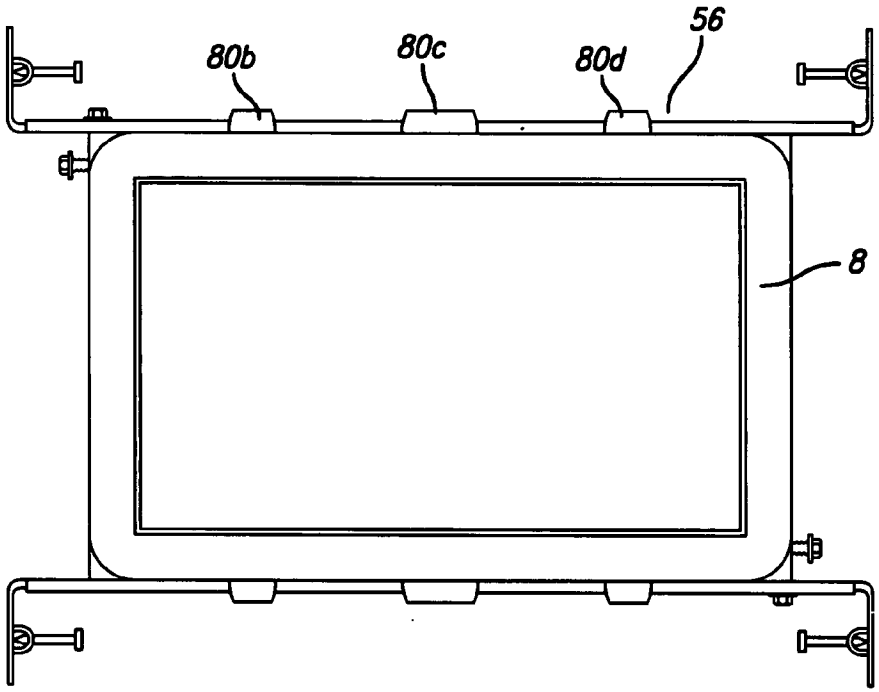
FIG. 23*a* is a top view of the boot hanger mounting bracket with the insert according to one of the preferred embodiment.
Figure 23B:
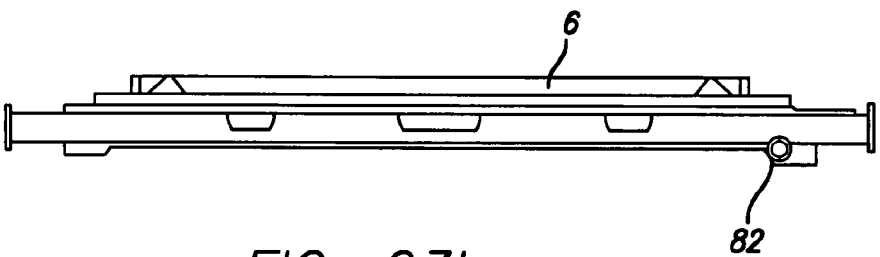
FIG. 23*b* is a side view of the boot hanger mounting bracket with the insert and gasket according to one version of the preferred embodiment.
Figure 23C:
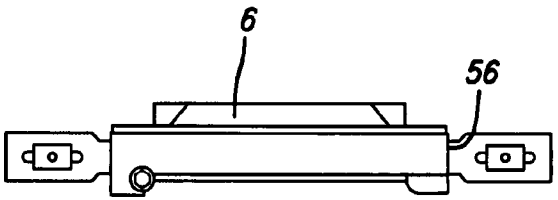
FIG. 23*c* is a side view of the boot hanger mounting bracket with the insert and gasket according to one version of the preferred embodiment.
Figure 24A:
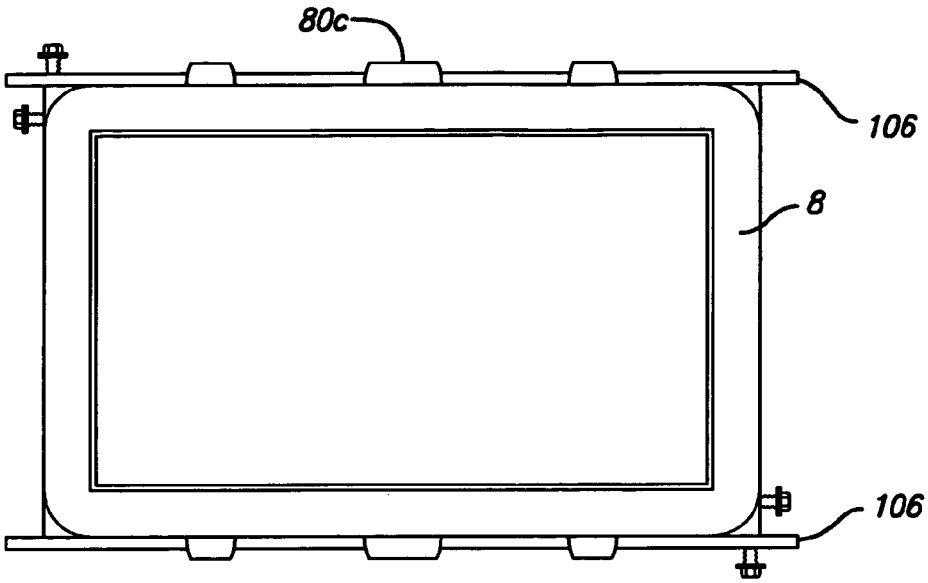
FIG. 24*a* is top view of the boot hanger mounting bracket and extended portions according to one version of the preferred embodiment.
Figure 24B:
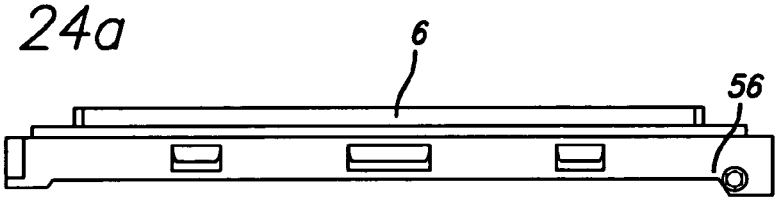
FIG. 24*b* is a side view of the boot hanger mounting bracket and extended portions according to one version of the preferred embodiment.
Figure 24C:
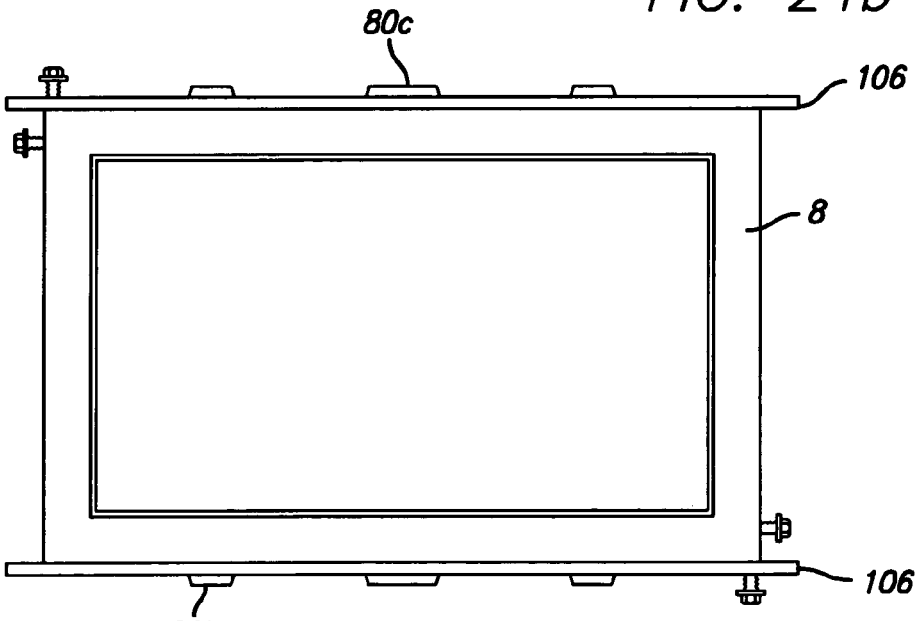
FIG. 24*c* is a bottom view of the boot hanger mounting bracket and extended portions according to one version of the preferred embodiment.
Figure 24D:
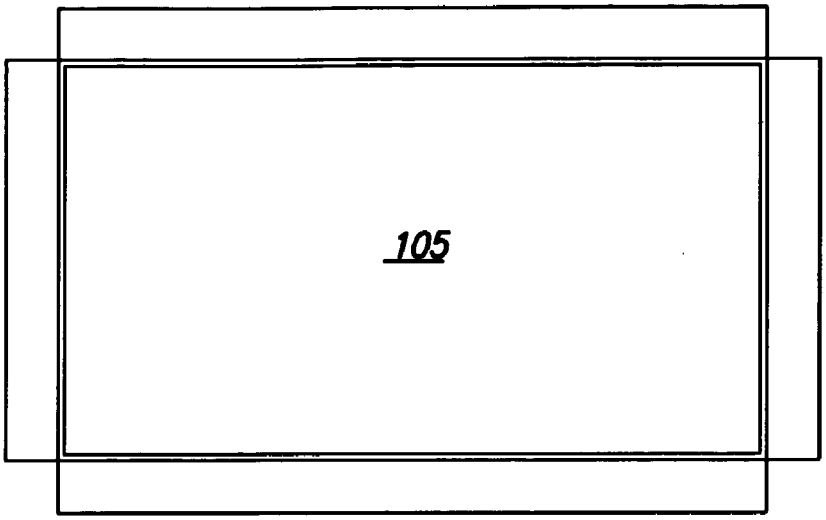
FIG. 24*d* is a top view of a fold pattern layout for the insert in one version of the preferred embodiment.
Figure 24E:
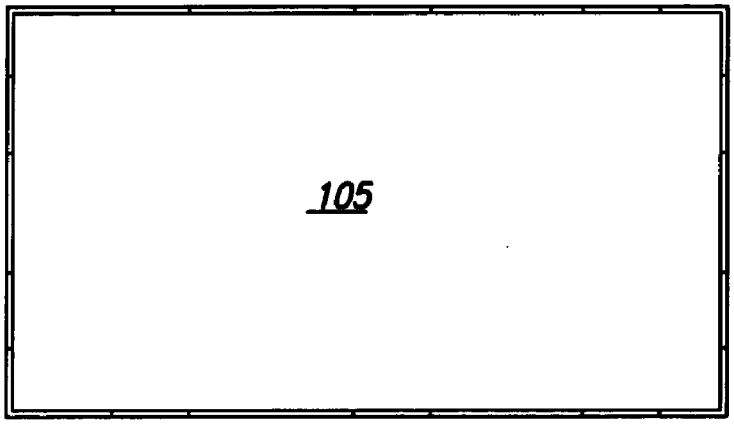
FIG. 24*e* is a top view of the insert in one version of the preferred embodiment.
Figure 24F:
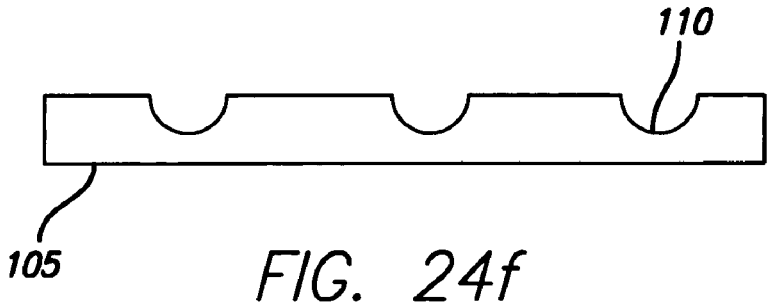
FIG. 24*f* is a side view of the insert in one version of the preferred embodiment.
Figure 24G:
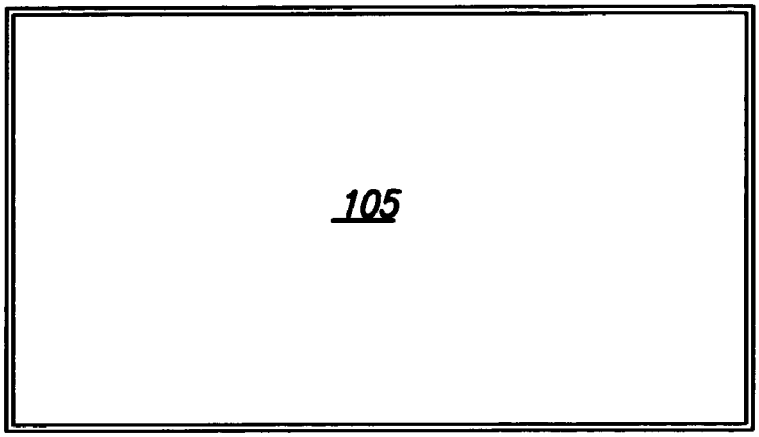
FIG. 24*g* is a bottom view of the insert in one version of the preferred embodiment.
Figure 24H:
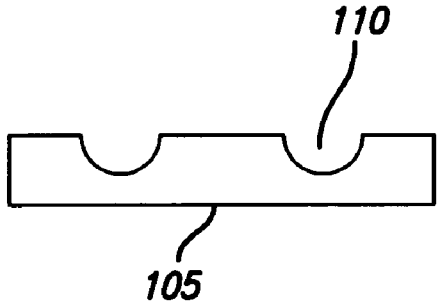
FIG. 24*h* is a side view of the insert in one version of the preferred embodiment.
Figure 24I:
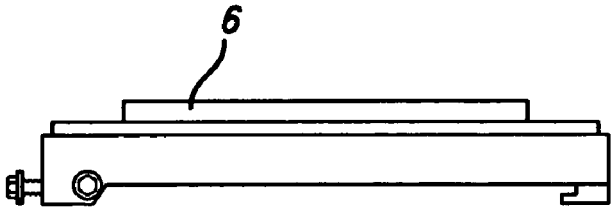
FIG. 24*i* is a side view of the boot hanger mounting bracket and insert in one version of the preferred embodiment.
Figure 25B:
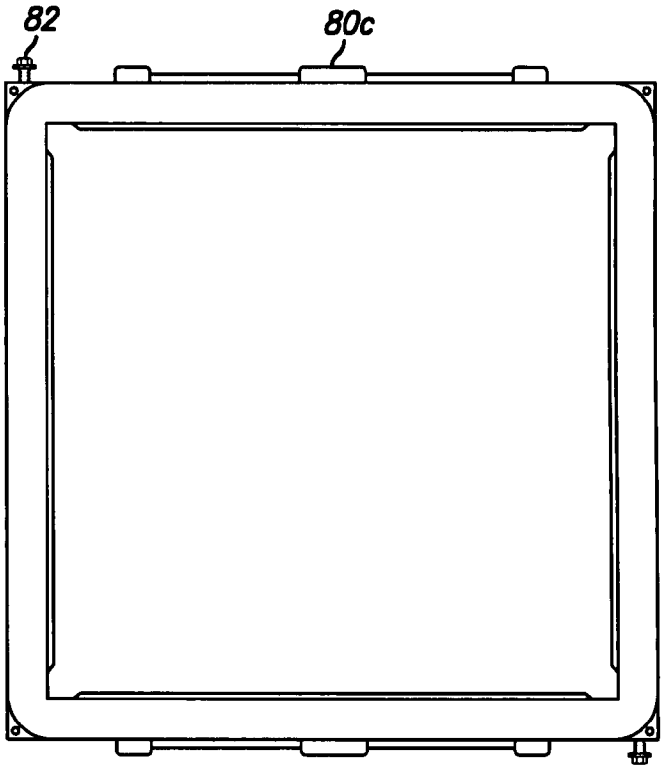
FIG. 25*b* is top view of the assembled boot hanger mounting bracket in one version of the preferred embodiment.
Figure 25C:
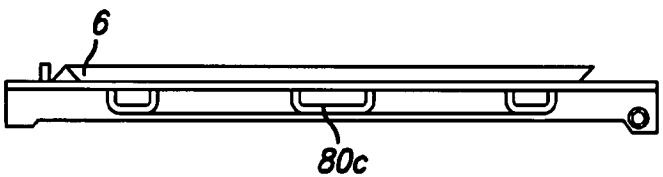
FIG. 25*c* is a side view of the assembled boot hanger mounting bracket in one version of the preferred embodiment.
Figure 25A:
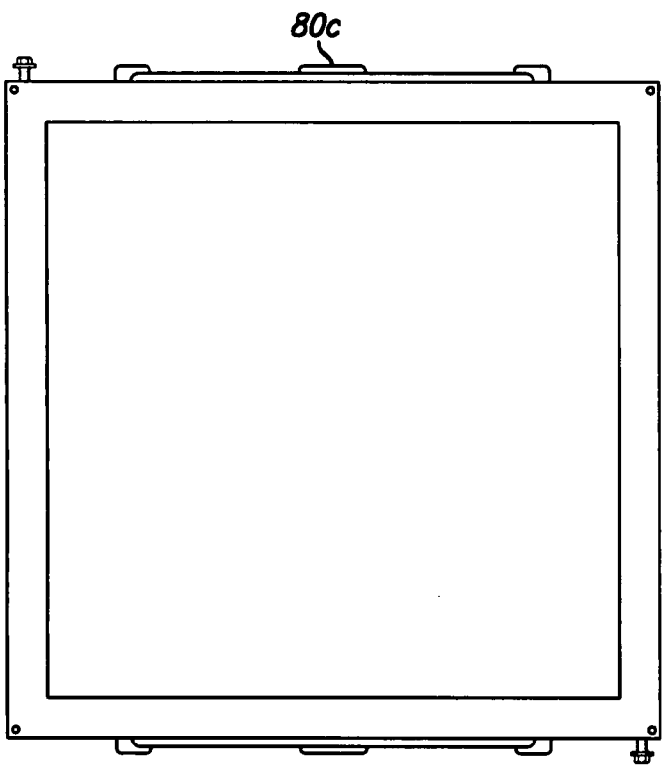
FIG. 25*a* is a bottom view of the assembled boot hanger mounting bracket in one version of the preferred embodiment.

FIGS. 1 and 7 show the configured boot hanger mounting bracket assembly 4 attached to spaced apart ceiling joists 58 of a building structure by boot hanger arms 56. The boot hanger arms 56 are attached to the ceiling joists 58 by a securing member 66 such as staples, screws or nails, or other suitable means known in the art. The boot hanger arm 56 may be comprised of two linear elements 68*a*, 68*b* and a bracket 70 (see e.g. FIGS. 18, 22). The linear elements 68*a*, 68*b* have a front surface 72 and a rear surface 74 and lengthwise edges 76*a*, 76*b* (see e.g. FIGS. 9–10, 18–19).

Figure 9A:
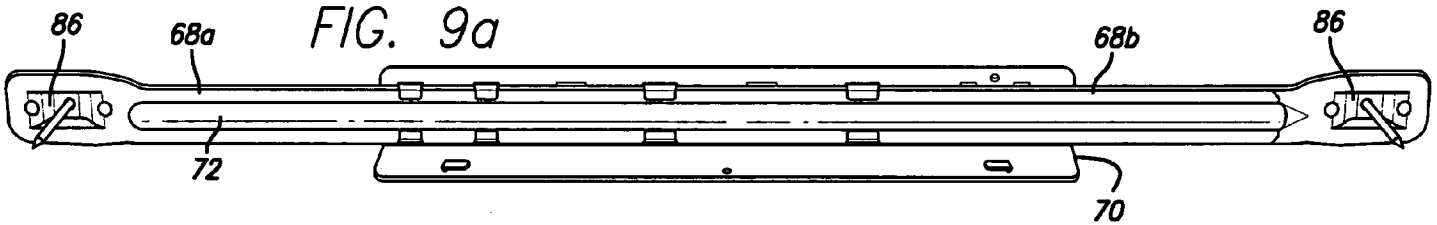
FIG. 9*a* is a perspective front view of the linear elements and bracket of the boot hanger arm in an alternate version of the present invention.
Figure 9B:
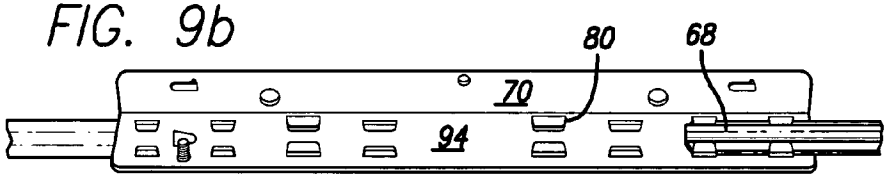
FIG. 9*b* is a perspective rear view of the bracket of the boot hanger arm in an alternate version of the present invention.
Figure 10A:
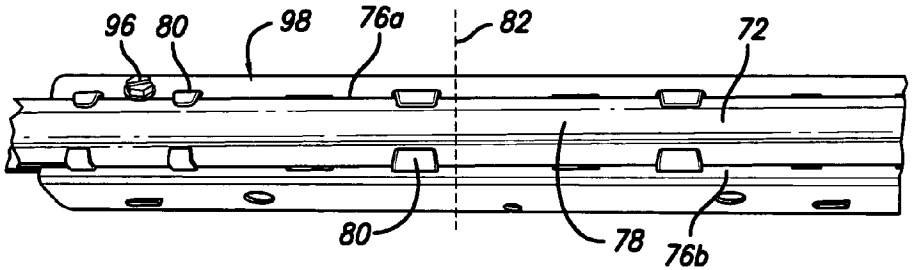
FIG. 10*a* is a perspective front view of the bracket of the boot hanger arm in an alternate version of the present invention.
Figure 10B:
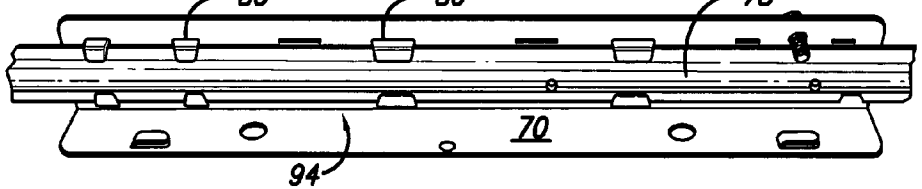
FIG. 10*b* is a perspective rear view of the bracket of the boot hanger arm in an alternate version of the present invention.
Figure 12A:
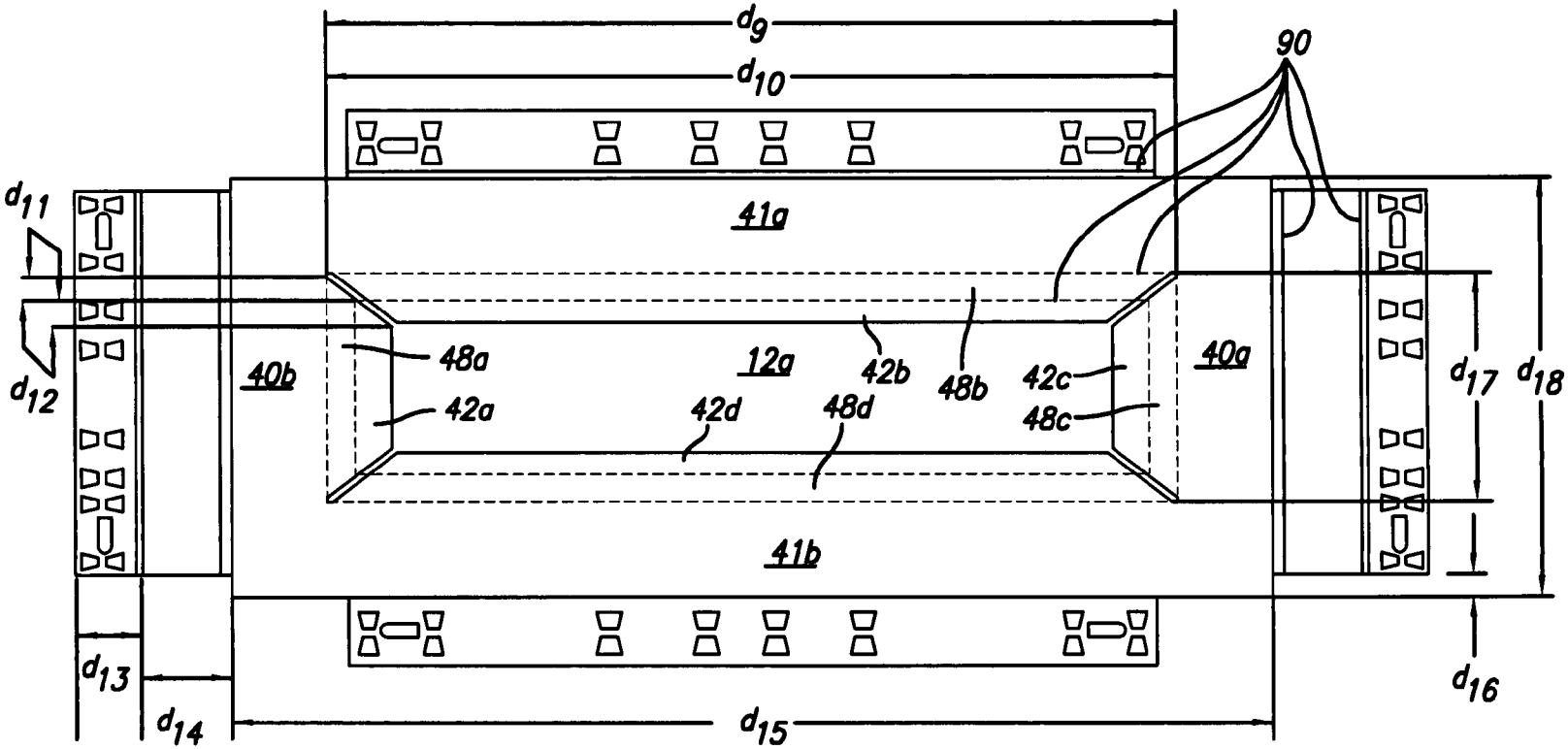
FIG. 12*a* is a top exploded view of the boot hanger frame portion and support member in an alternate version of the present invention.
Figure 13:
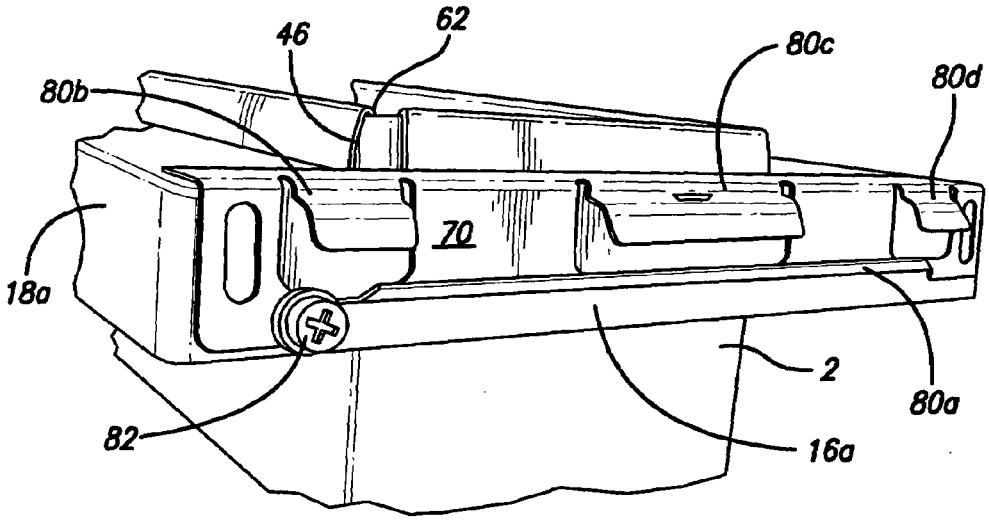
FIG. 13 is a side perspective view of the ductwork component, bracket and boot hanger frame portion in a first version of the preferred embodiment.
Figure 19:
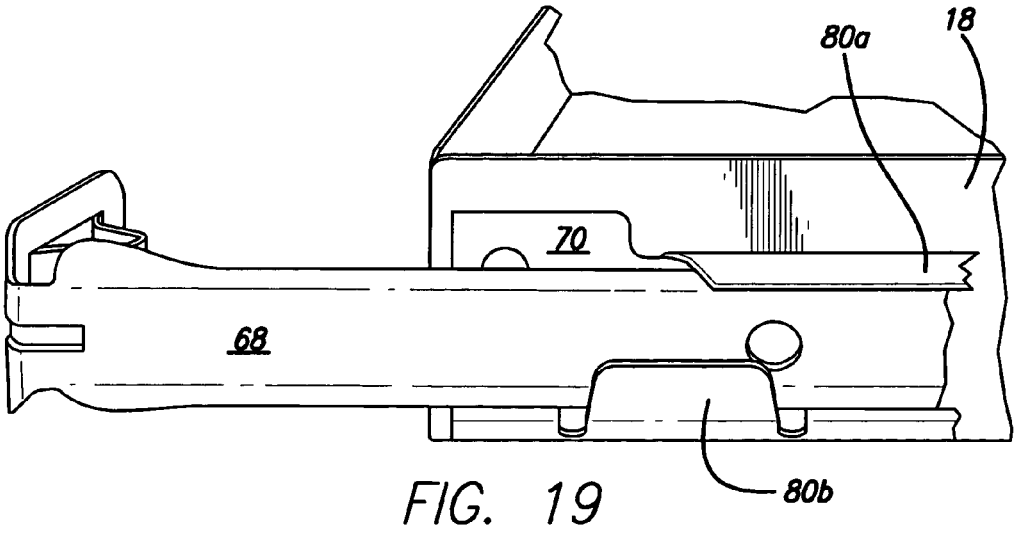
FIG. 19 is a front perspective view of the elongated element of the boot hanger arms and the bracket in a first version of the preferred embodiment.
Figure 20:
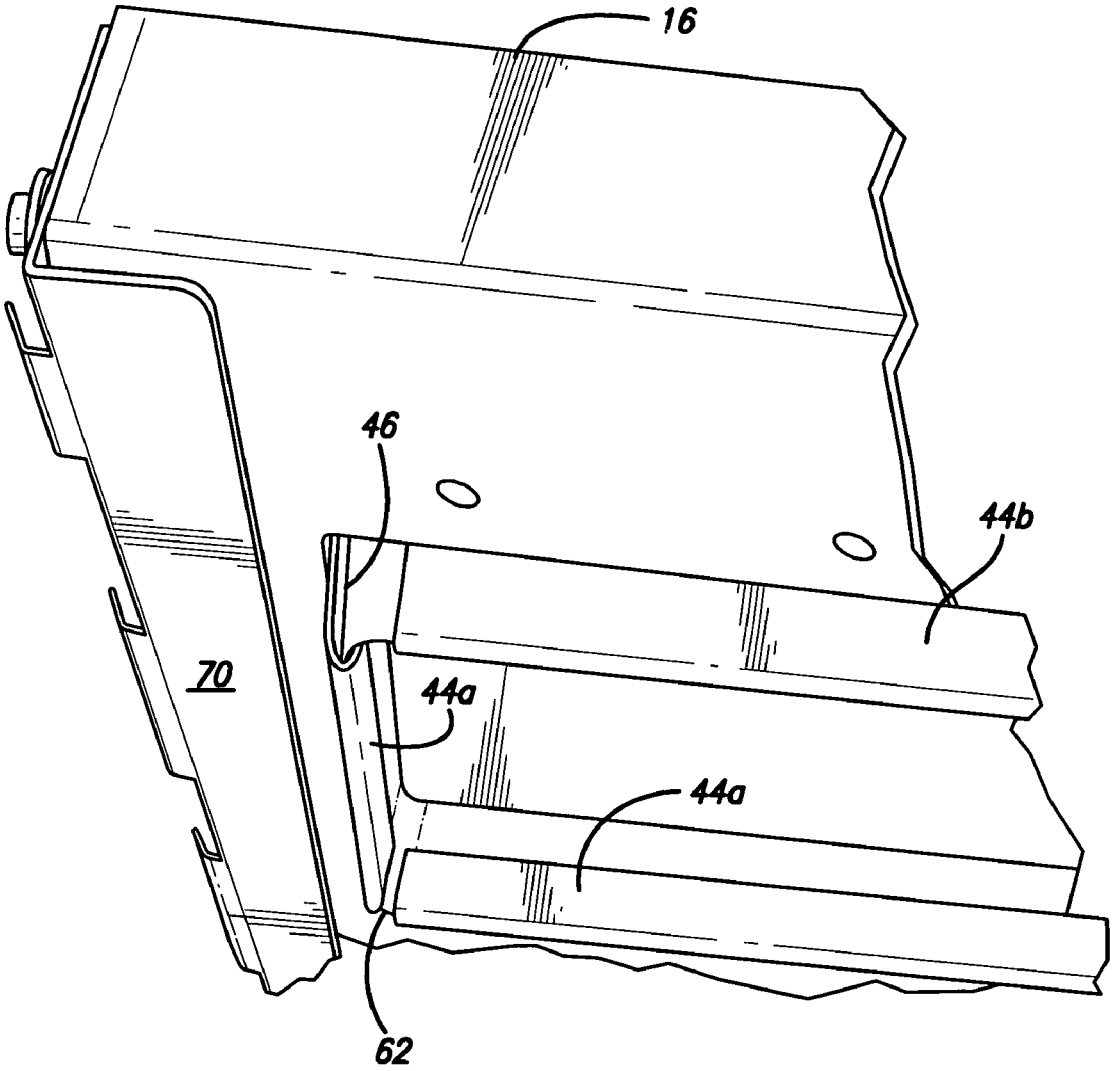
FIG. 20 is a side perspective view of the sidewalls of the support member, the boot hanger frame portion and the bracket in a first version of the preferred embodiment.
Figure 21:
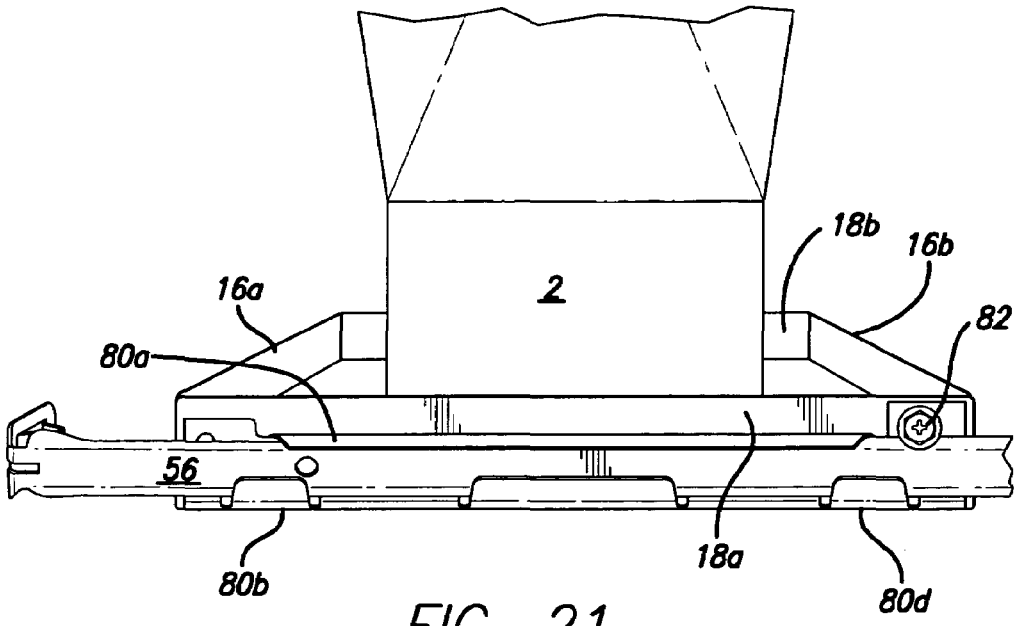
FIG. 21 is a front perspective view of the ductwork component, boot hanger arms and the bracket in a first version of the preferred embodiment.

Linear elements 68*a*, 68*b* are preferably configured so that they interface and are in sliding engagement with each other, permitting them to extend telescopically when interfaced. The two linear elements 68*a*, 68*b* preferably interface with the bracket 70 so that they are in sliding engagement with each other and with the bracket 70 (FIGS. 9*a*, 19, 21). The bracket 70 preferably comprises a plurality of engaging means such as tabs, hooks or grooves (FIGS. 13, 19, 21). Alternately, the engaging means may be formed integral with the boot hanger frame portion 8 to interface with the linear elements 68, without the need for a bracket 70. In a first version of the preferred embodiment, the bracket 70; or at least one of the flanges, if a bracket is not used; preferably comprises a single lengthwise groove 80*a* and three tabs 80*b*, 80*c*, 80*d*, although other configurations may also be suitable. In the preferred embodiment, tabs 80*b*, 80*c*, 80*d* may be arranged along the length of one side of the bracket 70 (see e.g. FIG. 13) or flange 16 or 18. Groove 80*a* is preferably arranged along the length of the opposite side of the bracket 70, or side of the boot hanger frame portion 8.

Groove 80*a* and tabs 80*b*, 80*c*, 80*d* preferably receive the edges of the linear element(s) 68, while permitting the linear element 68 to move and adjust laterally in a sliding manner towards and away from the midpoint 82 of the bracket 70; or from a point on the flange (e.g. where a bracket is not used). The configuration of the linear elements 68*a*, 68*b* , groove 80*a* and tabs 80*b*, 80*c* 80*d* permit adjustment of the boot hanger arm 56 to fit the particular dimensions of the ductwork and structure, such as the distance between ceiling joists 58.

Additionally, extended portions 106, if present on the boot hanger frame portion 8 flanges 16 or 18, permit added flexibility in that a set of boot hanger arms may be added on-site without the need for attaching an additional bracket 70. For example, boot hanger arm(s) 56 may be added to a side of the boot hanger frame portion 8 that does not include a bracket 70 by inserting the elongated elements 68 of the boot hanger arm(s) 56 through cut-outs 107 on the extended portion(s) 106 of parallel flanges (e.g. 18*a*, 18*b* or 16*a*, 16*b*), if, for example, the need arises at the work site. The boot hanger frame portion 8 may also be configured without any bracket(s) and with extended portions 106 being used for interfacing with the elongated elements 68. The extended portions 106 and cut-outs 107, also permit simplification of the manufacturing process in that fewer or no brackets 70 need to be fabricated and attached to the boot hanger frame portion 8.

Once adjusted to the particular application, the configuration of the boot hanger arm or arms 56 may be secured via a securing member 82 such as, for example, a screw and hole assembly that tightens to secure an edge of at least one of the linear elements 68 and prevents it from further sliding or movement (e.g. FIG. 13, FIG. 21).

Where brackets 70 are utilized, they may secured to each of two parallel flanges of the boot hanger frame portion 8 (e.g. 18*a*, 18*b* or 16*a*, 16*b*), although other configurations may be suitable, such as on each of the four flanges. The bracket 70 may be secured to the boot hanger frame portion 8 by a securing material 84 such as button punches, rivets, spot welds, glue, screws, epoxy, or other suitable means known in the art. The linear elements 68 of each boot hanger arm 56 preferably comprise a hole 86 at their distal ends 88 (e.g FIG. 9*a*) so that the boot hanger arm 56 may be secured to the ceiling joists 58 or other part of the structure by a securing member 66, such as nails or screws.

Once the boot hanger mounting bracket 4-ductwork component 2 assembly has been secured to the structure, an airflow control means 36 such as a grille louver or register may be fit to the opening defined by the configured boot hanger mounting bracket assembly 4. If desired, the airflow control means 36 may also be attached to the ceiling lid 60 or other part of the structure by a securing member such as threaded screws. The boot hanger mounting bracket 4, however, may be used as a support for the airflow control means 36, thereby lessening the need to utilize the ceiling lid 60, or other building structure for its support. The airflow control means 36 will generally comprise sidewalls forming a passageway directing airflow from the duct through the register, as well as adjustable louvers for controlling the airflow. The louvers may be selectively rotatable by the user to control the direction and volume of airflow, including blocking the passageway. The perimeter of the air flow control means 36 preferably extend beyond the duct opening to abut against the ceiling lid 60 floor or wall on opposite sides of the duct opening to prevent gaps and to provide a aesthetic appearance.

While the present invention has been described with regards to particular embodiments, it is recognized that additional variations of the present invention may be devised without departing from the inventive concepts. Additionally, the following Examples are presented to further illustrate preferred embodiments of the invention but are not intended to limit the present invention.

EXAMPLE I

Dimensions of a First Version of Support Member and Boot Hanger Frame Portion for Boot Hanger Mounting Bracket Assembly

| Dimension | Approx. Measurement in cm |
|---|---|
| boot hanger frame portion width, w | 20 cm |
| rearward facing flange 16 along width, w, of boot hanger frame portion (finished length) | 20 cm |
| boot hanger frame portion length, l | 36 cm |

-continued

| Dimension | Approx. Measurement in cm |
|---|---|
| rearward facing flange 18 along length, l, of boot hanger frame portion (finished length) | 36 cm |
| Overlap portion 102 of lengthwise flanges | Approximately 1 cm on each end of flange |
| Opening 12b in finished boot hanger mounting bracket | 30 cm (length) × 10 cm (width) |
| Size of support member 6 along length, l, of boot hanger frame portion 8 | 4.5 cm (width) × 29.5 cm (length) |
| Size of support member 6 along width, w, of boot hanger frame portion 8 | 4.5 cm (width) × 9.0 cm (length) |
| Width of lip 50 | 2.5 cm |
| Total width of inner tab 42 and outer tab 48 of support member(s) | 2.0 cm |
| Depth of pocket 46 | 1 cm |

EXAMPLE II

Dimensions of a Second Version of Support Member and Boot Hanger Frame Portion for Boot Hanger Mounting Bracket Assembly

| Dimension | Approx. Measurement in cm |
|---|---|
| boot hanger frame portion 8 width, w | 36 cm |
| boot hanger frame portion 8 length, l | 36 cm |
| Opening 12b in finished boot hanger mounting bracket 4 | 30 cm (length) × 30 cm (width) |

What is claimed is:

1. An apparatus for mounting ductwork of heating, cooling ventilation systems in a building structure, comprising:

a boot hanger frame portion comprising two pairs of parallel sides defining an opening;

at least one support member, comprising parallel sidewalls defining a pocket wherein an edge of the ductwork fits into the pocket, and wherein the support member interfaces with the boot hanger frame portion;

at least one flange projecting rearwardly from the boot hanger frame portion and comprising a pair of parallel edges and a rear edge; and at least one boot hanger arm; wherein the boot hanger arm interfaces with the flange and attaches to the building structure.

2. The apparatus of claim 1, wherein a length of the flange is greater than a length of the side of the boot hanger frame portion from which it projects.

3. The apparatus of claim 2, wherein the flange comprises at least one extended portion that extends beyond the side of the boot hanger frame portion from which the flange projects.

4. The apparatus of claim 3, wherein the extended portion comprises a cut out.

5. The apparatus of claim 4, wherein the cut out receives a portion of the boot hanger arm.

6. The apparatus of claim 5 comprising first and second boot hanger arms and at least a first rearwardly projecting flange and a second rearwardly projecting flange disposed in parallel relation to one another, wherein each of the first and second flanges comprise extended portions at their respective parallel edges and wherein each of the extended portions comprises a cut out.

7. The apparatus of claim 6, wherein the cut outs on the extended portions of the first flange receive a portion of the first boot hanger arm and wherein the cut outs on the extended portions of the second flange receive a portion of the second boot hanger arm.

8. The apparatus of claim 7, further comprising a pair of support members disposed in parallel relation to one another.

9. The apparatus of claim 1, further comprising a gasket.

10. The apparatus of claim 9, wherein the gasket is disposed between a portion of the building structure and the boot hanger frame portion.

11. The apparatus of claim 1 further comprising a bracket, wherein the bracket is attached to the flange and wherein the boot hanger arm slidingly engages with the bracket.

12. The apparatus of claim 11, comprising at least a first rearwardly projecting flange and a second rearwardly projecting flange disposed in parallel relation to one another, and first and second boot hanger arms, wherein the first and second rearwardly projecting flanges each comprise a bracket and wherein the first and second boot hanger arms slidingly engage, respectively, with the brackets on the first and second flanges.

13. The apparatus of claim 11, wherein the bracket comprises a plurality of tabs and wherein the boot hanger arms slidingly engage with the tabs.

14. The apparatus of claim 11 comprising at least a pair of support members.

15. The apparatus of claim 1, further comprising an airflow control means.

16. The apparatus of claim 1, further comprising an insert disposed within the opening during installation, wherein the insert is removed before operation of the heating, cooling or ventilation system.

17. The apparatus of claim 16, wherein the insert comprises a plurality of indentations for ease of removing the insert from the opening.

18. An apparatus for mounting ductwork of heating, cooling and ventilation systems in a building structure, comprising:

a boot hanger frame portion comprising two pairs of parallel sides defining an opening;

at least a pair of support members disposed in parallel relation to one another and each interfacing with the boot hanger frame portion, wherein each support member comprises parallel sidewalls defining a pocket and wherein an edge of the ductwork sits in the pocket;

a first flange and a second flange, wherein the first and second flanges each project rearwardly from the boot hanger frame portion and each comprise a pair of parallel edges and a rear edge; and a first boot hanger arm and a second boot hanger arm, wherein the first and second boot hanger arms interface respectively with the first and second flanges and attach to the building structure.

19. The apparatus of claim 18, wherein the first and second flanges each comprise tabs and wherein the first and second boot hanger arms slidingly interface with the respective tabs disposed on the first and second flanges.

20. The apparatus of claim 19, wherein the tabs are disposed respectively on a first bracket and a second bracket that are attached respectively to the first and second flanges.

21. The apparatus of claim 20, wherein the tabs are formed integral with, respectively, the first and second flanges.

22. The apparatus of claim 19, further comprising a securing element disposed on each of the first and second flanges to secure a position, respectively, of the first and second boot hanger arms.

23. The apparatus of claim 22, wherein the securing element is an element selected from the group consisting of bolts, screws and nuts that tighten to engage and secure the position of the boot hanger arms.

24. The apparatus of claim 18, wherein the boot hanger arms each comprise a first linear element and a second linear element that slidingly engage with one another to permit telescopic sizing of a length of the boot hanger arms.

25. The apparatus of claim 18, wherein a length of each of the first and second flanges is greater than a length of the respective side of the boot hanger frame portion from which the first and second flanges project.

26. The apparatus of claim 25, wherein the first and second flanges each comprise an extended portion at their parallel ends and wherein each of said extended extends beyond the respective side of the boot hanger frame portion from which the first and second flange project.

27. The apparatus of claim 26, wherein the extended portions each comprise a cut out for receiving a portion of one of the first and second boot hanger arms.

28. The apparatus of claim 27, wherein a portion of each of the first and second flanges forms an overlap with an adjacent flange projecting rearward from the boot hanger frame portion.

29. The apparatus of claim 18, further comprising an airflow control means.

30. A method for mounting ductwork of heating, cooling or ventilation systems in a building structure comprising a duct shaft and at least one building support structure comprising the steps of:

a. providing a least one prefabricated ductwork component having at least one edge;

b. providing at least one support member comprising a pocket;

c. providing a boot hanger frame portion comprising parallel sides and defining an opening;

d. providing at least one boot hanger arm comprising linear elements, wherein the linear elements each include a distal end and a proximal end and wherein the linear elements are in sliding engagement with one another;

e. configuring the boot hanger frame portion and support member to form a boot hanger mounting bracket assembly;

f. fitting the edge of the pre-fabricated ductwork component into the pocket of the support member;

g. configuring the boot hanger mounting bracket assembly, boot hanger arms and ductwork component in the building shaft;

h. slidingly adjusting the linear elements so that the boot hanger arm is configured to attach to the building support structure;

i. securing the linear elements to maintain configuration of the boot hanger arm; and j. securing the distal end of the linear elements of the boot hanger arm to a building support structure.

31. The method of claim 30, further comprising the step of providing a gasket.

32. The method of claim 31, wherein the gasket is disposed between a portion of the building structure and the boot hanger frame portion.

33. The method of claim 30, further comprising the set of providing an insert, wherein the insert is disposed in the opening defined by the parallel sides of the boot hanger frame portion.

34. The method of claim 33, wherein the insert comprises cut-outs for ease of removal from the opening.

35. The method of claim 33, wherein the insert is removed from the opening before operation of the heating, ventilation or cooling system.

36. The method of claim 30, comprising the further step of providing an airflow control means.

* * * * *